US010513367B2

(12) United States Patent
Smalley et al.

(10) Patent No.: US 10,513,367 B2
(45) Date of Patent: Dec. 24, 2019

(54) CARTON WITH HANDLE

(71) Applicant: Graphic Packaging International, Inc., Atlanta, GA (US)

(72) Inventors: Brian Smalley, Bristol (GB); John Carsten Nielsen, St Clair (AU); Renae Kylie Yeomans, Erskineville (AU)

(73) Assignee: Graphic Packaging International, LLC, Atlanta, GA (US)

( * ) Notice: Subject to any disclaimer, the term of this patent is extended or adjusted under 35 U.S.C. 154(b) by 295 days.

(21) Appl. No.: 15/430,662

(22) Filed: Feb. 13, 2017

(65) Prior Publication Data

US 2017/0233132 A1 Aug. 17, 2017

Related U.S. Application Data

(60) Provisional application No. 62/294,562, filed on Feb. 12, 2016.

(51) Int. Cl.
*B65D 5/46* (2006.01)
*B65D 71/36* (2006.01)
(Continued)

(52) U.S. Cl.
CPC ..... *B65D 5/46072* (2013.01); *B31B 50/14* (2017.08); *B31B 50/26* (2017.08);
(Continued)

(58) Field of Classification Search
CPC ..... B31B 50/26; B31B 2100/0026; B31B 2241/001; B31B 50/14; B31B 50/86; B65D 5/02; B65D 5/0227; B65D 5/18; B65D 5/32; B65D 5/42; B65D 5/4266; B65D 5/46; B65D 5/4608; B65D 5/4672; B65D 5/54; B65D 5/542; B65D 5/72; B65D 71/00; B65D 71/06; B65D 71/28; B65D 71/34; B65D 71/36; B65D 2571/00141;
(Continued)

(56) References Cited

U.S. PATENT DOCUMENTS 1,253,193 A 1/1918 Hill
2,375,631 A 5/1945 DeVillard
(Continued)

FOREIGN PATENT DOCUMENTS

BE 671762 3/1966
CA 8 777 92 8/1971
(Continued)

OTHER PUBLICATIONS

International Search Report and Written Opinion for PCT/US2017/017606 dated May 23, 2017.
(Continued)

*Primary Examiner* — Bryon P Gehman
(74) *Attorney, Agent, or Firm* — Womble Bond Dickinson (US) LLP

(57) ABSTRACT

A carton for carrying a plurality of articles. The carton has a plurality of panels for at least partially forming an interior of the carton. The plurality of panels includes a top panel, a bottom panel, and at least one side panel. A handle is in at least the top panel. The handle includes a handle feature in the top panel and a flexible handle panel adjacent the handle feature.

26 Claims, 13 Drawing Sheets

(51) Int. Cl.

| | |
|---|---|
| ***B65D 5/42*** | (2006.01) |
| ***B65D 5/62*** | (2006.01) |
| ***B65D 5/56*** | (2006.01) |
| ***B65D 5/10*** | (2006.01) |
| ***B31B 50/14*** | (2017.01) |
| ***B31B 50/26*** | (2017.01) |
| ***B31B 50/86*** | (2017.01) |

(52) U.S. Cl.

CPC ..... *B31B 50/86* (2017.08); *B65D 5/10* (2013.01); *B65D 5/4266* (2013.01); *B65D 5/56* (2013.01); *B65D 5/62* (2013.01); *B65D 71/36* (2013.01); *B65D 2571/0045* (2013.01); *B65D 2571/0066* (2013.01); *B65D 2571/00141* (2013.01); *B65D 2571/00574* (2013.01); *B65D 2571/00728* (2013.01)

(58) Field of Classification Search

CPC .. B65D 2571/00728; B65D 2571/0045; B65D 2571/00543; B65D 2571/00574; B65D 2571/0058; B65D 2571/0066; B65D 5/46072; B65D 5/10; B65D 5/56; B65D 5/62

USPC ..... 206/427, 428–435; 229/117.13, 117.14

See application file for complete search history.

(56) References Cited

U.S. PATENT DOCUMENTS

| | | | | |
|---|---|---|---|---|
| 2,383,183 | A | | 8/1945 | Fischer |
| 2,594,376 | A | | 4/1952 | Arneson |
| 2,702,144 | A | | 2/1955 | Forrer |
| 2,718,301 | A | | 9/1955 | Palmer |
| 2,785,847 | A | | 3/1957 | Forrer |
| 2,797,856 | A | | 7/1957 | Jaeschke |
| 2,810,506 | A | | 10/1957 | Kessler |
| 2,811,250 | A | | 10/1957 | Arneson |
| 2,849,111 | A | | 8/1958 | Fielding |
| 2,868,433 | A | | 1/1959 | Anderson, Jr. |
| 2,872,036 | A | | 2/1959 | Forrer |
| 2,874,869 | A | | 2/1959 | Hennessey |
| 2,922,561 | A | | 1/1960 | Currivan |
| 2,928,541 | A | | 3/1960 | Fielding |
| 2,955,739 | A | | 10/1960 | Collura |
| 3,112,856 | A | | 12/1963 | MacIntosh et al. |
| 3,127,720 | A | | 4/1964 | Gentry et al. |
| 3,178,242 | A | | 4/1965 | Ellis |
| 3,204,815 | A | | 9/1965 | Weiss |
| 3,257,066 | A | | 6/1966 | Williams |
| 3,269,531 | A | | 8/1966 | Weiss |
| 3,300,115 | A | | 1/1967 | Schauer |
| 3,306,519 | A | | 2/1967 | Wood |
| 3,309,005 | A | | 3/1967 | Pilger |
| 3,334,767 | A | | 8/1967 | Cornelius et al. |
| 3,339,723 | A | | 9/1967 | Wood |
| 3,353,709 | A | | 11/1967 | Lawrence |
| 3,355,012 | A | | 11/1967 | Weiss |
| 3,356,279 | A | | 12/1967 | Root |
| 3,371,846 | A | | 3/1968 | Detzel |
| 3,373,867 | A | | 3/1968 | Wood |
| 3,381,881 | A | | 5/1968 | Granz et al. |
| 3,554,402 | A | | 1/1971 | Lock |
| 3,593,849 | A | | 7/1971 | Helms |
| 3,635,452 | A | | 1/1972 | Helms |
| 3,669,342 | A | | 6/1972 | Funkhouse |
| 3,692,232 | A | | 9/1972 | Helms |
| 3,747,835 | A | | 7/1973 | Graser |
| 3,767,042 | A | | 10/1973 | Ganz |
| 3,828,926 | A | | 8/1974 | Rossi |
| 3,886,901 | A | | 6/1975 | Zeitler |
| 3,904,036 | A | | 9/1975 | Forrer |
| 3,933,303 | A | | 1/1976 | Kirby, Jr. |
| 3,963,121 | A | | 6/1976 | Kipp |
| 3,994,432 | A | | 11/1976 | Kirby, Jr. |
| 4,010,593 | A | | 3/1977 | Graham |
| 4,029,204 | A | | 6/1977 | Manizza |
| 4,034,852 | A | | 7/1977 | Forrer |
| 4,036,423 | A | | 7/1977 | Gordon |
| 4,096,985 | A | | 6/1978 | Wood |
| 4,101,069 | A | | 7/1978 | Wood |
| 4,111,306 | A | | 9/1978 | Roccaforte |
| 4,202,446 | A | | 5/1980 | Sutherland |
| 4,216,861 | A | | 8/1980 | Oliff |
| 4,222,485 | A | | 9/1980 | Focke |
| 4,295,562 | A | | 10/1981 | Wood |
| 4,314,634 | A | | 2/1982 | Stone |
| 4,318,474 | A | | 3/1982 | Hasegawa |
| 4,327,829 | A | | 5/1982 | Hughes |
| 4,328,893 | A | | 5/1982 | Oliff |
| 4,328,923 | A | | 5/1982 | Graser |
| 4,329,923 | A | | 5/1982 | Iida |
| 4,331,289 | A | | 5/1982 | Killy |
| 4,339,070 | A | | 7/1982 | Davies |
| 4,364,509 | A | | 12/1982 | Holley, Jr. |
| 4,375,258 | A | | 3/1983 | Crayne et al. |
| 4,378,905 | A | | 4/1983 | Roccaforte |
| 4,382,505 | A | | 5/1983 | Sutherland |
| 4,394,903 | A | | 7/1983 | Bakx |
| 4,405,078 | A | | 9/1983 | Dutcher |
| 4,424,901 | A | | 1/1984 | Lanier |
| 4,440,340 | A | | 4/1984 | Bakx |
| 4,463,852 | A | * | 8/1984 | Stone ..... B65D 71/36 206/427 |
| 4,470,503 | A | | 9/1984 | Stone |
| 4,478,334 | A | | 10/1984 | Graser |
| 4,498,581 | A | * | 2/1985 | Dutcher ..... B65D 71/36 206/427 |
| 4,498,619 | A | | 2/1985 | Roccaforte |
| 4,508,258 | A | | 4/1985 | Graser |
| 4,533,047 | A | | 8/1985 | Calvert |
| 4,538,759 | A | | 9/1985 | Dutcher |
| 4,545,485 | A | | 10/1985 | Oliff |
| 4,546,914 | A | | 10/1985 | Roccaforte |
| 4,558,816 | A | | 12/1985 | Wood |
| 4,566,593 | A | | 1/1986 | Muller |
| 4,577,799 | A | | 3/1986 | Oliff |
| 4,582,199 | A | | 4/1986 | Schuster |
| 4,588,084 | A | | 5/1986 | Holley |
| 4,637,515 | A | | 1/1987 | Wilson et al. |
| 4,653,686 | A | | 3/1987 | Wood |
| 4,681,217 | A | | 7/1987 | Hernandez |
| 4,681,252 | A | | 7/1987 | Doerr |
| 4,684,059 | A | | 8/1987 | Rusnock |
| 4,706,876 | A | | 11/1987 | Wilson |
| 4,728,025 | A | | 3/1988 | Oliff |
| 4,728,026 | A | | 3/1988 | Schuster |
| 4,747,487 | A | | 5/1988 | Wood |
| 4,747,534 | A | | 5/1988 | Marie |
| 4,784,266 | A | | 11/1988 | Chaussadas |
| 4,784,316 | A | | 11/1988 | Crouch |
| 4,785,991 | A | | 11/1988 | Schuster |
| 4,802,583 | A | | 2/1989 | Calvert |
| 4,804,089 | A | | 2/1989 | Wilson |
| 4,811,894 | A | | 3/1989 | Schuster |
| 4,830,267 | A | | 5/1989 | Wilson |
| 4,838,479 | A | | 6/1989 | Wood |
| 4,875,585 | A | | 10/1989 | Kadleck |
| 4,875,586 | A | | 10/1989 | Chaussadas |
| RE33,110 | E | | 11/1989 | Wood |
| 4,901,849 | A | | 2/1990 | Wilson |
| 4,919,266 | A | | 4/1990 | McIntosh, Jr. |
| 4,958,734 | A | | 9/1990 | Wood |
| 4,966,324 | A | | 10/1990 | Steel |
| 4,972,991 | A | | 11/1990 | Schuster |
| 4,974,771 | A | | 12/1990 | Lavery |
| 4,981,253 | A | | 1/1991 | Quaintance |
| 5,000,313 | A | | 3/1991 | Oliff |
| 5,002,186 | A | | 3/1991 | Cooper |
| 5,020,337 | A | | 6/1991 | Krieg |
| 5,042,660 | A | | 8/1991 | Carver |
| 5,060,792 | A | | 10/1991 | Oliff |
| 5,072,876 | A | | 12/1991 | Wilson |

(56) References Cited

U.S. PATENT DOCUMENTS

| | | | | |
|---|---|---|---|---|
| 5,094,359 | A | 3/1992 | DeMars | |
| 5,106,014 | A | 4/1992 | Miller | |
| 5,108,030 | A | 4/1992 | Schuster | |
| 5,119,985 | A | 6/1992 | Dawson | |
| 5,131,588 | A | 7/1992 | Oliff | |
| 5,180,100 | A | 1/1993 | Shimizu | |
| 5,195,676 | A | 3/1993 | LeBras | |
| 5,197,598 | A | 3/1993 | Stout et al. | |
| 5,221,041 | A | 6/1993 | Stout | |
| 5,222,658 | A | 6/1993 | DeMaio | |
| 5,234,102 | A | 8/1993 | Schuster | |
| 5,246,112 | A | 9/1993 | Stout | |
| 5,284,294 | A | 2/1994 | Floyd | |
| 5,292,058 | A | 3/1994 | Zoss | |
| 5,292,059 | A | 3/1994 | Oliff | |
| 5,297,673 | A | 3/1994 | Sutherland | |
| 5,297,725 | A | 3/1994 | Sutherland | |
| 5,303,863 | A | 4/1994 | Arasim | |
| 5,307,932 | A | 5/1994 | Stout | |
| 5,307,986 | A | 5/1994 | Schuster | |
| 5,320,277 | A | 6/1994 | Stout | |
| 5,333,734 | A | 8/1994 | Stout | |
| D350,480 | S | 9/1994 | Sutherland | |
| 5,351,878 | A | 10/1994 | Cooper | |
| 5,379,944 | A | 1/1995 | Stout | |
| 5,381,891 | A | 1/1995 | Harris | |
| 5,385,234 | A | 1/1995 | Stout | |
| 5,395,044 | A | 3/1995 | Stout | |
| 5,421,458 | A | 6/1995 | Campbell | |
| 5,427,241 | A | 6/1995 | Sutherland | |
| 5,458,234 | A | 10/1995 | Harris | |
| 5,472,090 | A | 12/1995 | Sutherland | |
| 5,472,138 | A | 12/1995 | Ingram | |
| 5,480,091 | A | 1/1996 | Stout | |
| 5,482,203 | A | 1/1996 | Stout | |
| 5,485,915 | A | 1/1996 | Harris | |
| 5,495,727 | A | 3/1996 | Strong | |
| 5,505,372 | A | 4/1996 | Edson | |
| 5,524,756 | A | 6/1996 | Sutherland | |
| 5,542,536 | A | 8/1996 | Sutherland | |
| 5,549,197 | A | 8/1996 | Sutherland | |
| 5,551,556 | A | 9/1996 | Sutherland | |
| 5,558,212 | A | 9/1996 | Sutherland | |
| 5,558,213 | A | 9/1996 | Sutherland | |
| 5,582,343 | A | 12/1996 | Dalvey | |
| 5,593,027 | A | 1/1997 | Sutherland | |
| 5,595,291 | A | 1/1997 | Negelen | |
| 5,595,292 | A | 1/1997 | Bates | |
| 5,597,071 | A | 1/1997 | Sutherland | |
| 5,609,251 | A | 3/1997 | Harris | |
| 5,639,017 | A | 6/1997 | Fogle | |
| 5,647,483 | A | 7/1997 | Harris | |
| 5,664,401 | A | 9/1997 | Portrait | |
| 5,669,500 | A | 9/1997 | Sutherland | |
| 5,682,995 | A | 11/1997 | Sutherland | |
| 5,692,614 | A | 12/1997 | Harris | |
| 5,699,957 | A | 12/1997 | Blin | |
| 5,704,470 | A | 1/1998 | Sutherland | |
| 5,738,273 | A | 4/1998 | Auclair | |
| 5,778,630 | A | 7/1998 | Portrait | |
| 5,794,778 | A | 8/1998 | Harris | |
| 5,796,778 | A | 8/1998 | Kurker | |
| 5,819,920 | A | 10/1998 | Sutherland | |
| 5,826,782 | A | 10/1998 | Stout | |
| 5,826,783 | A | 10/1998 | Stout | |
| 5,853,088 | A | 12/1998 | Saulas | |
| 5,855,318 | A | 1/1999 | Baxter | |
| 5,873,515 | A | 2/1999 | Dunn et al. | |
| 5,878,946 | A | 3/1999 | Frerot | |
| 5,906,313 | A | 5/1999 | Oliff | |
| 5,915,546 | A | 6/1999 | Harrelson | |
| 5,931,300 | A | 8/1999 | Sutherland | |
| 5,937,620 | A | 8/1999 | Chalendar | |
| 5,941,453 | A | 8/1999 | Oliff | |
| 5,947,367 | A | 9/1999 | Miller | |
| 5,975,286 | A | 11/1999 | Oliff | |
| 5,992,733 | A | 11/1999 | Gomes | |
| 5,996,883 | A | 12/1999 | Bates | |
| 6,019,220 | A | 2/2000 | Sutherland | |
| 6,019,276 | A | 2/2000 | Auclair | |
| 6,021,898 | A | 2/2000 | Sutherland | |
| 6,021,899 | A | 2/2000 | Sutherland | |
| 6,065,590 | A | 5/2000 | Spivey | |
| 6,105,853 | A | 8/2000 | Lamare | |
| 6,105,854 | A | 8/2000 | Spivey | |
| 6,109,438 | A | 8/2000 | Sutherland | |
| 6,126,066 | A | 10/2000 | Peterson | |
| 6,129,266 | A | 10/2000 | Oliff | |
| 6,131,803 | A | 10/2000 | Oliff | |
| 6,155,480 | A | 12/2000 | Botsford | |
| 6,158,586 | A | 12/2000 | Muller | |
| 6,164,526 | A | 12/2000 | Dalvey | |
| 6,170,741 | B1 | 1/2001 | Skolik | |
| 6,227,367 | B1 | 5/2001 | Harrelson | |
| 6,237,839 | B1 | 5/2001 | Brown | |
| 6,250,542 | B1 | 6/2001 | Negelen | |
| 6,260,755 | B1 | 7/2001 | Bates | |
| 6,273,330 | B1 | 8/2001 | Oliff | |
| 6,289,651 | B1 | 9/2001 | LeBras | |
| 6,302,320 | B1 | 10/2001 | Stout | |
| 6,315,123 | B1 | 11/2001 | Ikeda | |
| 6,425,520 | B1 | 7/2002 | Peterson | |
| 6,484,903 | B2 | 11/2002 | Spivey | |
| 6,523,739 | B2 | 2/2003 | Heeley et al. | |
| 6,536,656 | B2 | 3/2003 | Auclair | |
| 6,550,616 | B2 | 4/2003 | LeBras | |
| 6,631,803 | B2 | 10/2003 | Rhodes et al. | |
| 6,695,137 | B2 | 2/2004 | Jones | |
| 6,758,337 | B2 | 7/2004 | Chargueraud | |
| 6,766,940 | B2 | 7/2004 | Negelen | |
| 6,811,525 | B2 | 11/2004 | Culpepper | |
| 6,848,573 | B2 | 2/2005 | Gould | |
| 6,866,185 | B2 | 3/2005 | Harrelson | |
| 6,896,130 | B2 | 5/2005 | Theelen | |
| 6,905,066 | B2 | 6/2005 | Holley, Jr. | |
| 6,926,193 | B2 | 8/2005 | Smalley | |
| 6,942,140 | B2 | 9/2005 | Merzeau | |
| 6,948,651 | B2 | 9/2005 | Ikeda | |
| 6,968,992 | B2 | 11/2005 | Schuster | |
| 6,981,631 | B2 | 1/2006 | Fogle | |
| 6,988,617 | B2 | 1/2006 | Gomes | |
| 7,007,800 | B2 | 3/2006 | LeBras | |
| 7,007,836 | B2 | 3/2006 | Smalley | |
| 7,159,759 | B2 | 1/2007 | Sutherland | |
| 7,273,161 | B2 | 9/2007 | Fogle | |
| 7,427,010 | B2 | 9/2008 | Sutherland | |
| 7,448,492 | B2 | 11/2008 | Sutherland | |
| 7,472,791 | B2 | 1/2009 | Spivey, Sr. | |
| 7,743,968 | B2 | 6/2010 | Theelen | |
| 7,748,603 | B2 | 7/2010 | Fogle | |
| 7,757,933 | B2 | 7/2010 | Dunn | |
| 7,762,397 | B2 | 7/2010 | Coltri-Johnson | |
| 7,793,779 | B2 | 9/2010 | Spivey, Sr. | |
| 7,806,314 | B2 | 10/2010 | Sutherland | |
| 8,191,761 | B2 | 6/2012 | Brand | |
| 8,348,142 | B2 | 1/2013 | Smalley | |
| 8,479,973 | B2 | 7/2013 | Brand | |
| 8,596,518 | B2 * | 12/2013 | Babcock | B65D 5/443 229/117.16 |
| 8,978,963 | B2 | 3/2015 | Kastanek | |
| 8,985,433 | B2 | 3/2015 | Sutherland | |
| 9,199,774 | B2 | 12/2015 | Smalley et al. | |
| 9,376,230 | B2 | 6/2016 | Kastanek et al. | |
| 9,376,244 | B2 | 6/2016 | Kastanek et al. | |
| 9,604,767 | B2 | 3/2017 | Ramsuer | |
| 9,656,789 | B2 * | 5/2017 | Requena | B65D 71/34 |
| 10,059,485 | B2 | 8/2018 | Spivey, Sr. | |
| 2003/0000182 | A1 | 1/2003 | Portrait et al. | |
| 2003/0080180 | A1 | 5/2003 | Holley, Jr. et al. | |
| 2003/0132130 | A1 | 7/2003 | Bras | |
| 2003/0213263 | A1 | 11/2003 | Woog | |
| 2004/0011674 | A1 | 1/2004 | Theelen | |
| 2004/0074854 | A1 | 4/2004 | Lin | |
| 2004/0089671 | A1 | 5/2004 | Miller | |

(56) References Cited

U.S. PATENT DOCUMENTS

| | | | |
|---|---|---|---|
| 2004/0188277 | A1 | 9/2004 | Auclair |
| 2004/0188301 | A1 | 9/2004 | Gomes |
| 2004/0238611 | A1 | 12/2004 | Sutherland |
| 2004/0243277 | A1 | 12/2004 | Bonnain et al. |
| 2004/0254666 | A1 | 12/2004 | Bonnain et al. |
| 2005/0001020 | A1 | 1/2005 | Garner |
| 2005/0056658 | A1 | 3/2005 | Spivey |
| 2005/0167478 | A1 | 8/2005 | Holley |
| 2005/0178791 | A1 | 8/2005 | Miller |
| 2005/0194430 | A1 | 9/2005 | Auclair et al. |
| 2006/0169755 | A1 | 8/2006 | Spivey |
| 2006/0191811 | A1 | 8/2006 | Fogle et al. |
| 2006/0255108 | A1 | 11/2006 | Shmagin |
| 2006/0273143 | A1 | 12/2006 | Finch |
| 2007/0017962 | A1 | 1/2007 | Russ |
| 2007/0029371 | A1 | 2/2007 | Theelen |
| 2007/0039846 | A1 | 2/2007 | Spivey |
| 2007/0051781 | A1 | 3/2007 | Holley, Jr. |
| 2007/0056869 | A1 | 3/2007 | Tokarski |
| 2007/0090175 | A1 | 4/2007 | Schemmel |
| 2007/0108261 | A1 | 5/2007 | Schuster |
| 2007/0164091 | A1 | 7/2007 | Fogle |
| 2007/0181658 | A1 | 8/2007 | Sutherland |
| 2007/0205255 | A1 | 9/2007 | Dunn |
| 2007/0284424 | A1 | 12/2007 | Holley |
| 2007/0295789 | A1 | 12/2007 | Ho Fung |
| 2008/0067223 | A1 | 3/2008 | Jego |
| 2008/0073420 | A1 | 3/2008 | Walling et al. |
| 2009/0236408 | A1 | 9/2009 | Spivey |
| 2010/0044420 | A1 | 2/2010 | Brand |
| 2010/0213249 | A1 | 8/2010 | Requena |
| 2011/0036902 | A1 | 2/2011 | Smalley |
| 2012/0321754 | A1 | 12/2012 | Block |
| 2013/0043299 | A1 | 2/2013 | Sutherland |
| 2014/0238882 | A1 | 8/2014 | Requena |
| 2015/0151889 | A1 | 6/2015 | Kastanek |
| 2016/0009442 | A1 | 1/2016 | Block et al. |

FOREIGN PATENT DOCUMENTS

| | | | | |
|---|---|---|---|---|
| CA | 1 243 987 | | 11/1988 | |
| CA | 2 160 145 | | 9/1995 | |
| DE | 85 14 718.4 | | 6/1985 | |
| DE | 91 04 905.9 | | 6/1991 | |
| DE | 92 03 858.1 | | 5/1992 | |
| DE | 296 07 374 | | 4/1996 | |
| DE | 201 12 228 | | 11/2002 | |
| DE | 102004006899 | A1 * | 11/2004 | ..... B65D 71/36 |
| DE | 20 200 4018 649 | | 4/2005 | |
| EP | 0 473 266 | | 3/1992 | |
| EP | 0 509 749 | | 10/1992 | |
| EP | 0 459 658 | | 12/1992 | |
| EP | 0 520 411 | | 12/1992 | |
| EP | 1 612 157 | | 1/2006 | |
| EP | 2 149 506 | | 2/2010 | |
| FR | 1 438 035 | | 1/1965 | |
| FR | 2 698 074 | | 5/1994 | |
| GB | 1 101 345 | | 1/1968 | |
| GB | 2 202 825 | | 10/1988 | |
| GB | 2 209 515 | | 5/1989 | |
| JP | 5-112373 | | 5/1993 | |
| JP | 7-11566 | | 2/1995 | |
| JP | H08-2551 | | 1/1996 | |
| JP | 10-338266 | | 12/1998 | |
| JP | 2003-200967 | | 7/2003 | |
| JP | 2004-533378 | | 11/2004 | |
| JP | 2007-055630 | | 3/2007 | |
| JP | 2008-013200 | | 1/2008 | |
| WO | WO 96/27538 | | 9/1996 | |
| WO | WO 97/27124 | | 7/1997 | |
| WO | WO 98/09871 | | 3/1998 | |
| WO | WO 99/28207 | | 6/1999 | |
| WO | WO 00/78618 | | 12/2000 | |
| WO | WO 01/66434 | | 9/2001 | |
| WO | WO 02/102208 | | 12/2002 | |
| WO | WO 03/004377 | | 1/2003 | |
| WO | WO 03/008292 | | 1/2003 | |
| WO | WO 03/037742 | | 5/2003 | |
| WO | WO 2005/042370 | | 5/2005 | |
| WO | WO 2005/080218 | | 9/2005 | |
| WO | WO 2005/123532 | | 12/2005 | |
| WO | WO 2007/089282 | | 8/2007 | |
| WO | WO 2009/117562 | | 9/2009 | |
| WO | WO 2011/022378 | | 2/2011 | |

OTHER PUBLICATIONS

Supplementary European Search Report for EP 17 75 0940 dated Sep. 12, 2019.

* cited by examiner

CARTON WITH HANDLE

CROSS REFERENCE TO RELATED APPLICATIONS

This application claims the benefit of U.S. Provisional Patent Application No. 62/294,562 filed Feb. 12, 2016.

INCORPORATION BY REFERENCE

The disclosure of U.S. Provisional Patent Application No. 62/294,562, which was filed Feb. 12, 2016, is hereby incorporated by references for all purposes as if presented herein in its entirety.

BACKGROUND OF THE DISCLOSURE

The present disclosure generally relates to cartons or carriers for holding beverage containers or other types of articles. More specifically, the present disclosure relates to cartons that include handle features for carrying the carton.

SUMMARY OF THE DISCLOSURE

In general, one aspect of the disclosure is directed to a carton for carrying a plurality of articles. The carton comprises a plurality of panels for at least partially forming an interior of the carton. The plurality of panels comprising a top panel, a bottom panel, and at least one side panel. A handle is in at least the top panel. The handle comprises a handle feature in the top panel and a flexible handle panel adjacent the handle feature.

In another aspect, the present disclosure is generally directed to a blank for forming a carton for carrying a plurality of articles. The blank comprising a plurality of panels for at least partially forming an interior of the carton formed from the blank. The plurality of panels comprising a top panel, a bottom panel, and at least one side panel. A handle is in at least the top panel. The handle comprises a handle feature in the top panel and a flexible handle panel adjacent the handle feature.

In another aspect, the present disclosure is generally directed to a method of forming a carton for carrying a plurality of articles. The method comprising obtaining a blank comprising a plurality of panels comprising a top panel, a bottom panel, and at least one side panel, a handle in at least the top panel, the handle comprises a handle feature in the top panel and a flexible handle panel adjacent the handle feature. The method comprises folding the plurality of panels to at least partially form an interior of the carton.

Other aspects, features, and details of the present disclosure can be more completely understood by reference to the following detailed description of exemplary embodiments taken in conjunction with the drawings.

BRIEF DESCRIPTION OF THE DRAWINGS

Those skilled in the art will appreciate the above stated advantages and other advantages and benefits of various additional embodiments reading the following detailed description of the embodiments with reference to the below-listed drawing figures. Further, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to carriers, packages, constructs, sleeves, cartons, or the like, for holding and displaying containers such as jars, bottles, cans, etc. The containers can be used for packaging food and beverage products, for example. The containers can be made from materials suitable in composition for packaging the particular food or beverage item, and the materials include, but are not limited to, glass; plastics such as PET, LDPE, LLDPE, HDPE, PP, PS, PVC, EVOH, and Nylon; and the like; aluminum and/or other metals; or any combination thereof.

Cartons according to the present invention can accommodate articles of any shape. For the purpose of illustration and not for the purpose of limiting the scope of the invention, the following detailed description describes beverage containers as disposed within the carton embodiments. In this specification, the terms "inner," "interior," "outer," "exterior," "lower," "bottom," "upper," and "top" indicate orientations determined in relation to fully erected and upright cartons.

Figure 1:
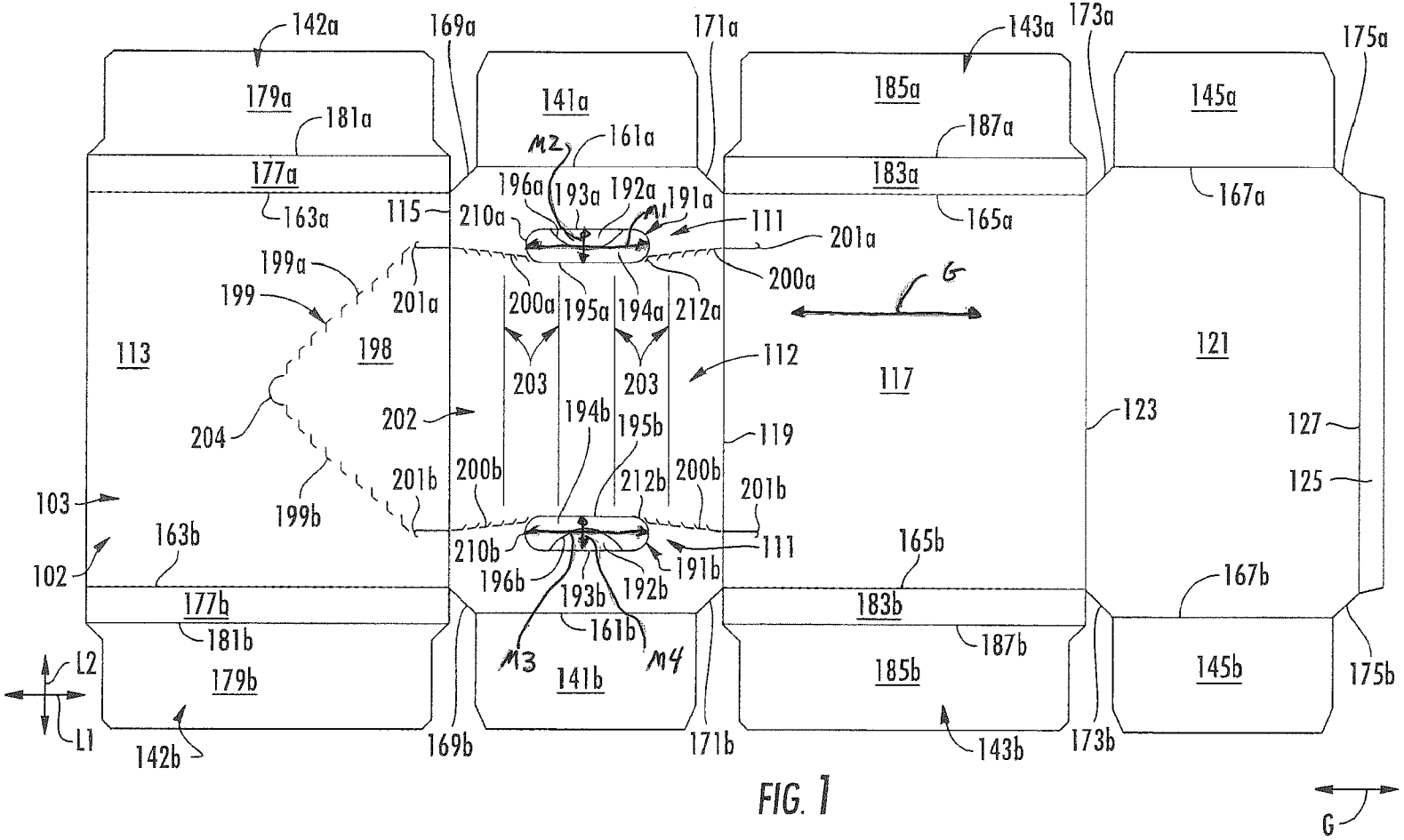
FIG. 1 is a plan view of an exterior surface of a blank for forming a carton according to a first embodiment of this disclosure.
Figure 3:
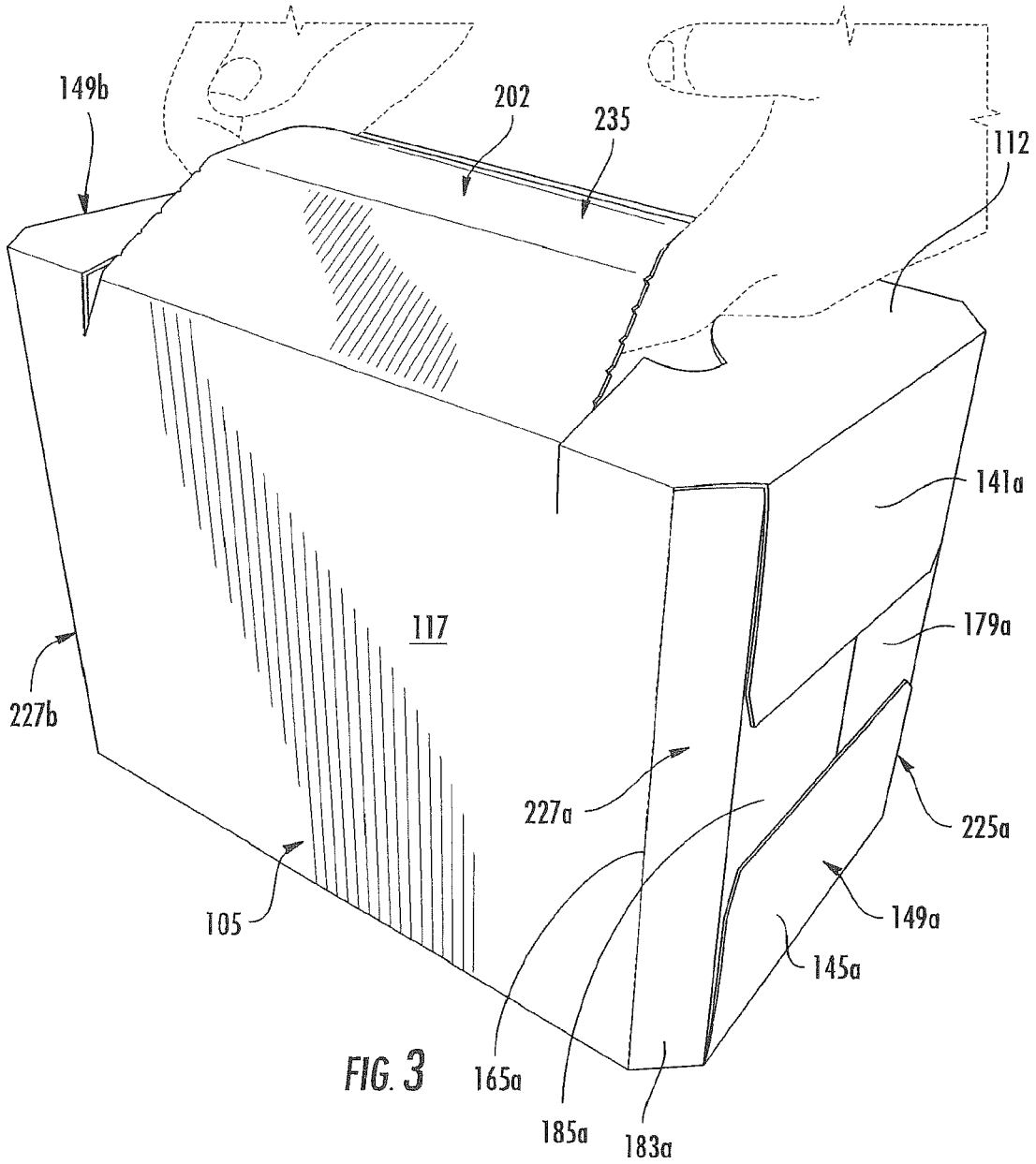
FIG. 3 is a perspective view of the carton of FIG. 1 with a flexible handle panel activated.
Figure 4:
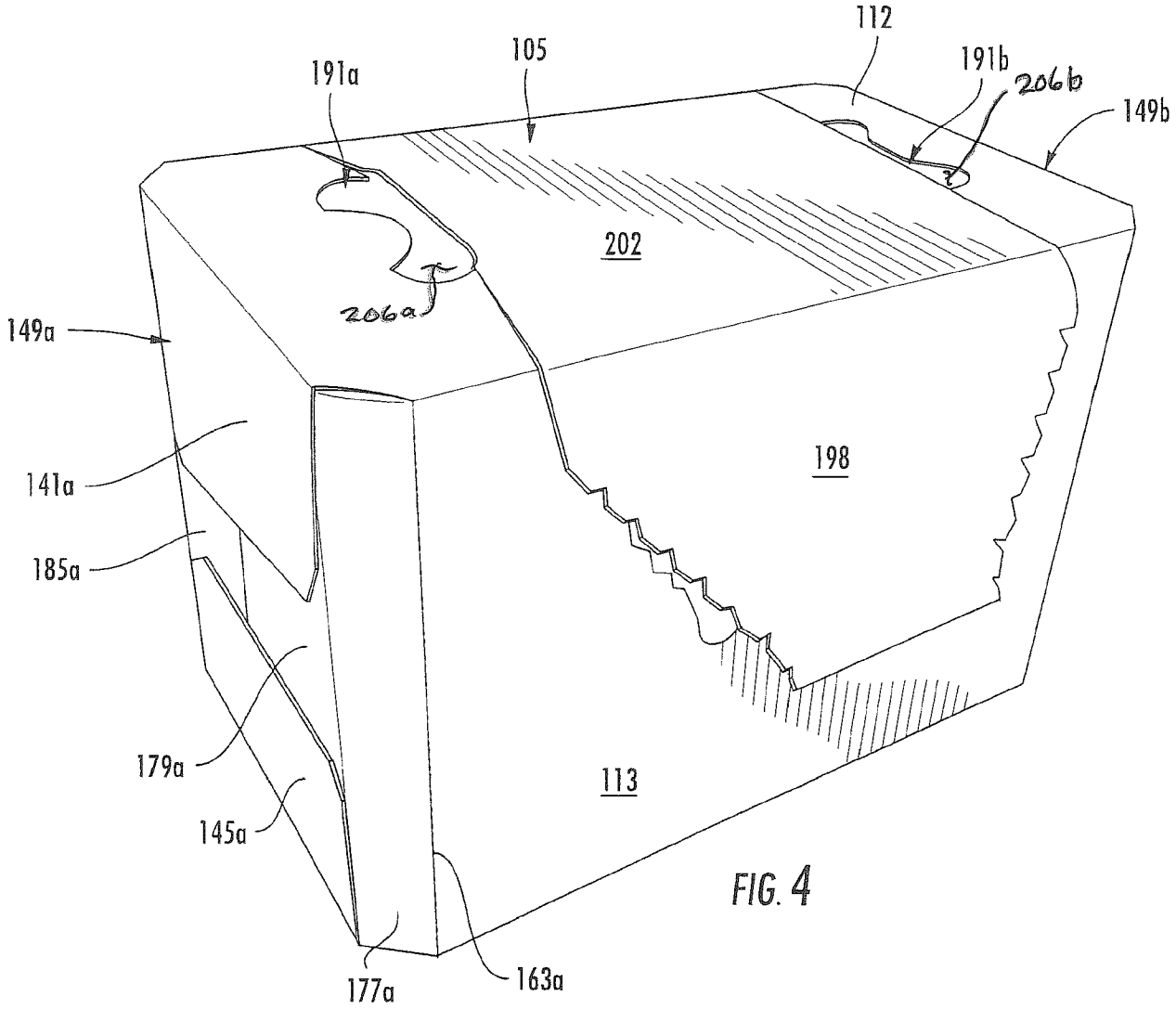
FIG. 4 is a perspective view of the carton of FIG. 1 with a dispenser panel partially separated.
Figure 5:
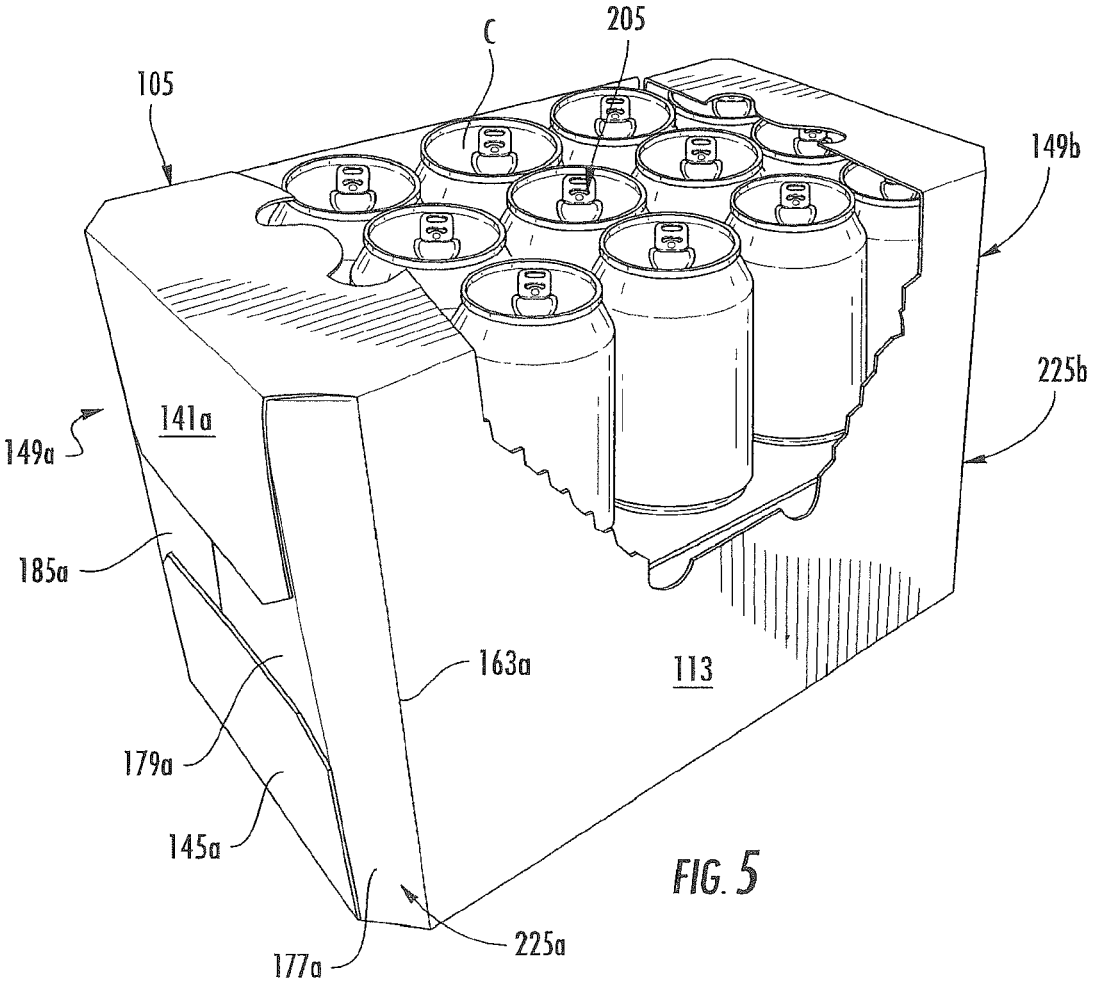
FIG. 5 is a perspective view of the carton of FIG. 1 with the dispenser panel separated.

FIG. 1 is a plan view of an exterior surface 102 of a blank 103, used to form a carton 105, shown in FIGS. 2-5, according to the exemplary embodiment of the disclosure. The carton 105 can be used to house a plurality of articles such as containers C (FIG. 5). The blank 103 has handle features, generally indicated at 111, for forming the handle 235 for grasping and carrying the carton 1. In one embodiment, the blank 103 is sized to form a carton 105 that contains thirty containers C in two layers with each layer having fifteen containers (e.g., a 3×5×2 arrangement). But, it is understood that the blank 103 and/or carton 105 may be sized and shaped to hold containers C of a different or same quantity in a single layer or more than two layers and/or in different row/column arrangements (e.g., 3×6, 2×3, 2×4, 2×6, 2×4, 2×2×3, 3×6×3, 3×4×2, etc.). In one embodiment, the containers C are cans, but other types of containers (e.g., bottles) can be used in the carton 105. The carton 105 can include various opening features, dispensing features, and handle features without departing from the disclosure. In one embodiment, the carton 105 comprises a handle 235 comprising a flexible handle panel 202 in the top of the carton. The handle 235 includes a first handle 191*a* and a second handle 191*b* that are located at respective sides of the flexible handle panel 202. The handles 191*a*, 191*b* can be oriented parallel to the grain of the material of the carton for increasing strength of the carton. Also, the positioning of the handle features of the carton 105 allows the carton to be safely lifted with two hands and enables a proper lifting technique to reduce or prevent injury.

As shown in FIG. 1, the blank 103 has a longitudinal axis L1 and a lateral axis L2. The blank 103 of the illustrated embodiment is formed of a paper-based composite material, for example, paperboard or cardboard, such that a direction G of the grain of the blank 103, e.g., the general direction along which the fibers that constitute the material of the blank 103, is in parallel with the longitudinal axis L1. Since the longitudinal axis L1 extends along the length of the blank 103, and the blank 103 is shown having a length greater than its width, the blank 103 can be considered as formed of a long-grain material. In other embodiments, the direction G of the grain of the blank 103 may be in a direction parallel with the axis L2, and/or the blank 103 may have a width greater than its length.

In the illustrated embodiment, the blank 103 comprises a top panel 112 foldably connected to a first side panel 113 at a lateral fold line 115, a second side panel 117 foldably connected to the top panel at a lateral fold line 119, a bottom panel 121 foldably connected to the second side panel 117 at a lateral fold line 123, and an attachment panel 125 foldably connected to the bottom panel 121 at a lateral fold line 127.

In one embodiment, the panels 112, 113, 117, 121 have respective first end flaps 141*a*, 142*a*, 143*a*, 145*a* at a first marginal portion of the blank 103 such that the first end flaps are foldably connected to respective panels to close a first end 149*a* of the carton 105. As shown in FIG. 1, the top end flap 141*a* is foldably connected to the top panel 112 at a longitudinal fold line 161*a*, the side end flap 142*a* is foldably connected to the first side panel 113 at a longitudinal fold line 163*a*, the side end flap 143*a* is foldably connected to the second side panel 117 at a longitudinal fold line 165*a*, and the bottom end flap 145*a* is foldably connected to the bottom panel 121 at a longitudinal fold line 167*a*. The first end flaps 141*a*, 142*a*, 143*a*, 145*a* can be otherwise arranged, shaped, or modified without departing from the scope of the disclosure.

In one embodiment, the top panel 112 includes a first oblique edge 169*a* extending between the fold lines 161*a*, 163*a* and a second oblique edge 171*a* extending between the fold lines 161*a*, 165*a*. Similarly, the bottom panel 121 includes a first oblique edge 173*a* between the fold lines 165*a*, 167*a* and a second oblique edge 175*a* between the fold line 167*a* and the lateral fold line 127. As shown in FIG. 1, the side end flap 142*a* includes a base portion 177*a* foldably connected to the first side panel 113 at fold line 163*a* and a distal portion 179*a* foldably connected to the base portion 177*a* at a longitudinal fold line 181*a*. The side end flap 143*a* includes a base portion 183*a* foldably connected to the second side panel 117 at the fold line 165*a* and a distal portion 185*a* foldably connected to the base portion 183*a* at a longitudinal fold line 187*a*. The edges of the top panel and the bottom panel may be arranged, shaped, or modified without departing from the scope of the disclosure. For example, the edges of the top panel 112 and the bottom panel 121 may be curved or orthogonal without departing from the disclosure.

As shown in FIG. 1, the panels 112, 113, 117, 121 have respective second end flaps 141*b*, 142*b*, 143*b*, 145*b* at a second marginal portion of the blank 103 such that the second end flaps are foldably connected to respective panels to close a second end 149*b* of the carton (FIG. 4). In one embodiment, the second marginal portion of the blank 103 is a mirror image of the first marginal portion. The second end flaps 141*b*, 142*b*, 143*b*, 145*b* are shaped to have identical features as the first end flaps 141*a*, 142*a*, 143*a*, 145*a*. As such, the second end flaps 141*b*, 142*b*, 143*b*, 145*b* are foldably connected to a respective panel 112, 113, 117, 121 at a respective fold line 161*b*, 163*b*, 165*b*, 167*b*.

In the illustrative embodiment, the top panel 112 has first and second oblique edges 169*b*, 171*b* and the bottom panel 121 has first and second oblique edges 173*b*, 175*b* each at the second marginal portion of the blank. The side end flap 142*b* at the second marginal portion of the blank 103 has a base portion 177*b* foldably connected to the first side panel 113 at the longitudinal fold line 163*b* and a distal portion 179*b* foldably connected to the base portion 177*b* at a longitudinal fold line 181*b*. As shown in FIG. 1, the side end flap 143*b* includes a base portion 183*b* foldably connected to the second side panel 117 at the fold line 165*b* and a distal portion 185*b* foldably connected to the base portion 183*b* at a longitudinal fold line 187*b*. The second end flaps 141*b*, 142*b*, 143*b*, 145*b* and the oblique edges 169*b*, 171*b*, 173*b*, 175*b* could be otherwise shaped, arranged, and/or configured without departing from the disclosure.

In one embodiment, the handle features 111 include a first handle 191*a* in the top panel 112 having a first handle flap 192*a* foldably connected to the top panel 112 along a longitudinal fold line 193*a* and a second handle flap 194*a* foldably connected to the top panel 112 along a longitudinal fold line 195*a*. A curved cut 196*a* extends between respective ends of the fold line 193*a* and separates the first flap 192*a* and the second flap 194*a*. As shown in FIG. 1, the first handle 191*a* includes curved cuts 210*a*, 212*a* extending between respective ends of fold lines 193*a*, 195*a* to define the second handle flaps 194*a*. In one embodiment, the first handle flap 192*a* and/or the second handle flap 194*a* may be omitted or alternatively the handle 191*a* may comprise an opening instead of the handle flaps without departing from the disclosure. One or both of the first handle flap 192*a* and the second handle flap 194*a* are folded to form a first handle opening 206*a* of the first handle 191*a* for carrying the carton 105.

As shown in FIG. 1, the handle features 111 include a first tear line 200*a* extending generally from each end of the first handle 191*a* toward a respective fold line 115, 119. In some embodiments, the first tear line terminates at respective j-shaped cuts 201*a* in the first side panel 113 and the second side panel 117, although only one or neither end of the first tear line 200*a* may terminate in a j-shaped cut, or the handle features 111 can be otherwise alternatively arranged without departing from the disclosure.

Figure 2:
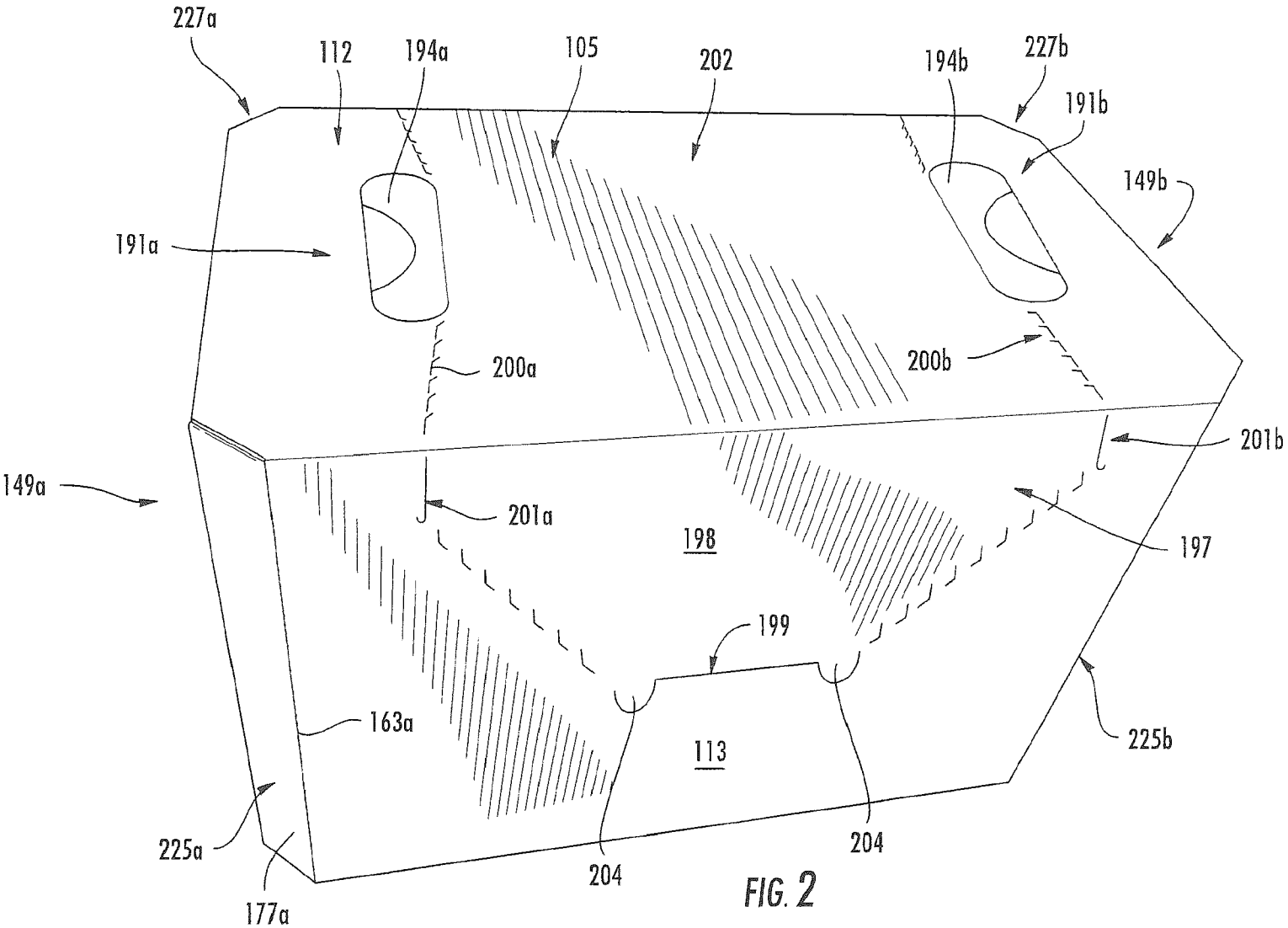
FIG. 2 is a perspective view of the carton of FIG. 1.

In the illustrated embodiment, the first side panel 113 comprises a dispenser 197 having a dispenser panel 198 removably attached to the carton at a tear line, generally indicated at 199. The tear line 199 comprises an access tab 204 and two oblique portions 199*a*, 199*b* extending from the access tab and ending near or adjacent respective j-shaped cuts 201*a*, 201*b* in the side panel 113. The tear line 199 could be otherwise shaped, arranged, and/or configured without departing from the disclosure. For instance, the tear line 199 could be shaped to include lateral portions and multiple access tabs 204 on one or both sides, as illustrated in FIGS. 2, 4 and 5, without departing from this disclosure. In the illustrated embodiment, the dispenser 197 includes the dispenser panel 198 in the first side panel 113 and the flexible handle panel 202 extending from the dispenser panel in the first side panel, across the top panel 112, and into a portion of the second side panel 117. Further, the dispenser panel 198 could be omitted from the carton 105 without departing from the disclosure.

In one embodiment, the handle features 111 in the top panel 112 include a second handle 191*b* having a third handle flap 192*b* foldably connected to the top panel 112 along a longitudinal fold line 193*b* and a fourth handle flap 194*b* foldably connected to the top panel 112 along a longitudinal fold line 195*b*. A curved cut 196*b* extends between respective ends of the fold line 193*b* and separates the third handle flap 192*b* and the fourth handle flap 194*b*. As shown in FIG. 1, the second handle 191*b* includes curved cuts 201*b*, 212*b* extending between respective ends of fold lines 193*b*, 195*b* to define the fourth handle flap 194*b*. In one embodiment the third handle flap and/or the fourth handle flap 194*b* may be omitted or alternatively the handle 191*b* may comprise an opening instead of the handle flaps without departing from the disclosure. As with the first handle 191*a*, the second handle 191*b* is oriented parallel to the grain direction G that is in the longitudinal direction L1. Further, the handle features 111 include a second tear line 200*b* extending generally from each end of the second handle 191*b* and terminating at a respective j-shaped cut 201*b* in a respective one of the first side panel 113 and the second side panel 117. The second handle 191*b* can be alternatively arranged, could comprise an opening, or could be omitted without departing from the disclosure.

In this regard, the first and second handles 191*a*, 191*b* each have a respective major axis M1, M3, e.g., an axis along their longest dimension in the plane defined by the blank 103, extending in parallel with the longitudinal axis L1, and a respective minor axis M2, M4, e.g., an axis along their shortest dimension in the plane defined by the blank 103, extending in parallel with the lateral axis L2 and substantially perpendicular to the respective axis M1, M3. The handle features 111 including one or both of the first and second handles 191*a*, 191*b* can be alternatively arranged without departing from the disclosure. For example, the first handle 191*a* and/or the second handle 191*b* can be oriented 180 degrees such that the fold lines 193*b* and 195*b* are reversed without departing from the spirit of the disclosure. As shown, the fold lines 193*a*, 193*b*, 195*a*, 195*b* of the handles 191*a*, 191*b* are also oriented to be substantially parallel to the grain direction G of the material of the blank 103.

As illustrated in FIG. 1, the handles 191*a* and 191*b* are placed parallel with the grain direction G of the material (e.g., paperboard, cardboard, or other suitable material), increasing the tear strength of the carton 105 when lifted at the handles 191*a*, 191*b*. The increase in tear strength of the handles when lifted allows for a lower caliper paperboard to be used than compared to standard cartons thus reducing cost of the carton and reducing environmental impact.

In one embodiment, the first tear line 200*a*, the second tear line 200*b*, the fold lines 195*a*, 195*b*, and the j-shaped cuts 201*a*, 201*b* define the flexible handle panel 202 in the carton 105. The flexible handle panel 202 extends between the fold lines 115, 119 across the entire width of the top panel 111, extends into a portion of the first side panel 113 by extending from the fold line 115 to the termination of the J-shaped cuts 201*a*, 201*b* in the first side panel 113, and extends into a portion of the second side panel 117 by extending from the fold line 119 to the termination of the J-shaped cuts 201*a*, 201*b* in the second side panel 117. A plurality of lateral lines of weakening (e.g., fold lines) 203 may extend at least partially across the handle panel 202. In one embodiment, the flexible handle panel 202 comprises a portion of the top panel 112, a portion of the side panel 113, and a portion of the side panel 117. The flexible handle panel 202 could be otherwise shaped, arranged, and configured without department from the disclosure.

In one exemplary method, the carton 105 can be formed from the blank 103 by folding the blank 103 along the lateral fold line 119 so that the second side panel 117 overlaps at least a portion of the interior surface of the top panel 112 and first side panel 113. Then folding the blank along the lateral fold line 127 so that the attachment panel 125 is in face-to-face contact with the interior of first side panel 113. Alternatively, the blank could be folded along the lateral fold lines 115, 123 so that the first side panel 113 overlaps the attachment panel 125 and the top panel 112. The attachment panel 125 can be glued to the first side panel 113.

The blank 103 then can be folded along fold lines 115, 119, 123, 127 to form an open-ended sleeve with an interior 205. The containers or articles can be loaded into the interior 205 of the open-ended sleeve before or after closing either of the ends 149*a*, 149*b*. The blank 103 may be otherwise formed into the open-ended sleeve using alternative folding and gluing steps without departing from the scope of this disclosure.

Next, each respective end can be closed by at least partially overlapping and adhering the end flaps 141*a*, 142*a*, 143*a*, 145*a* at the end 149*a* of the carton 105 and at least partially overlapping and adhering the end flaps 141*b*, 142*b*, 143*b*, 145*b* at the other end 149*b* of the carton. In one embodiment, the base portions 177*a*, 183*a* of respective side end flaps 142*a*, 143*a* are angled or positioned to be oblique relative to the side panels 113, 117 with the distal portions 179*a*, 185*a*, positioned to be generally perpendicular to the side panels 113, 117. The top end flap 141*a* and the bottom end flap 145*a* are folded inwardly along respective fold lines 161*a*, 167*a* to at least partially overlap the base portions 179*a*, 185*a*. Further, the base portions 179*a*, 185*a* are adhered in face-to-face contact with the end flaps 141*a*, 145*a*. As shown in FIG. 4, the oblique base portions 177*a*, 183*a* of the end flaps 142*a*, 143*a* conform to respective oblique edges 169*a*, 171*a*, 173*a*, 175*a* of the top panel 112 and the bottom panel 121 to form respective angled corners 225*a*, 227*a* at the end 149*a* of the carton 105.

In one embodiment, the second end 149*b* of the carton 105 can be closed in a similar manner as the first end 149*a* by folding, respectively overlapping, and selectively adhering the end flaps 141*b*, 142*b*, 143*b*, 145*b*. In one embodiment, the base portions 177*b*, 183*b* of respective side end flaps 142*b*, 143*b* are angled or positioned to be oblique relative to the side panels 113, 117 with the distal portions 179*b*, 185*b* positioned to be generally perpendicular to the side panels 113, 117. The top end flap 141*b* and the bottom end flap 145*b* are folded inwardly respective fold lines 161*b*, 167*b* to at least partially overlap the base portions 179*b*, 185*b*. Further, the base portions 179*b*, 185*b* are adhered in face-to-face contact with the end flaps 141*b*, 145*b*. As shown in FIG. 2, the oblique base portions 177*b*, 183*b* of the end flaps 142*b*, 143*b* conform to respective oblique edges 169*b*, 171*b*, 173*b*, 175*b* of the top panel 112 and the bottom panel 121 to form respective angled corners 225*b*, 227*b* at the end 149*b* of the carton 105. The assembled carton 105 is shown in FIG. 2. The ends 149*a*, 149*b* of the carton 105 could be closed by other closing steps and features without departing from the disclosure. One or both of the ends 149*a*, 149*b* could be otherwise shaped, arranged, configured, or omitted, without departing from the disclosure.

One exemplary method of forming the flexible handle 235, as shown in FIG. 3, includes folding the handle flaps 194*a*, 194*b* inward along respective fold lines 195*a*, 195*b* to form the handle openings 206*a*, 206*b*. Then, the carton 105 can be carried at the handle 235 by a user inserting a hand through a respective handle opening 206*a*, 206*b* and grasping the flexible handle panel 202 to initiate tearing along tear lines 200*a*, 200*b* and cuts 201*a*, 201*b*. As shown in FIG. 3, the carton 105 can be carried by the handle 235 by lifting the flexible handle panel 202 so that the flexible handle panel flexes upwardly when the carton is grasped at the handles 191*a*, 191*b* adjacent the flexible handle panel. The handle 235 allows the consumer or user to lift the carton 105 while using two hands and the recommended lifting technique of bending at the knees and maintaining a natural curve of the back. The oriented handles 191*a*, 191*b*, fold lines 195*a*, 195*b*, and tear lines 200*a*, 200*b*, and j-shaped cuts 201*a*, 201*b* are generally parallel with the grain direction G of the material of the board, increasing the strength of the carton 105 when lifted thus requiring a lower caliper board reducing costs of the carton and reducing environmental impact. The fold lines 193*a*, 193*b* 195*a*, 195*b* of the handles 191*a*, 191*b* are oriented to be parallel to the grain direction G of the material of the top panel 112. The handle 235, the first and second handles 191*a*, 191*b*, and flexible panel 202 could have features or otherwise positioned without departing from the disclosure.

As described above, the handles 191*a* and 191*b* are uniquely placed with their respective major axes M1, M3 in parallel with the grain direction G of the material (e.g., paperboard, cardboard, or etc.) of the blank 103 that forms the carton 105. This orientation of the handles 191*a*, 191*b* results in stresses generated in the course of lifting the carton 105 due to the weight of the carton 105 being distributed generally perpendicular to the grain direction G, as shown. Due to the fibers that constitute the material of the blank 103 that forms the carton 105 being generally oriented in the grain direction G, the material of the blank 103 generally tears more easily along the grain direction G than in the direction parallel to the grain direction G, for example, because the bodies of the fibers must be sheared across in this direction to effect tearing. In this regard, orientation of the major axes M1, M3 of the handles 191*a*, 191*b* in the grain direction G results in tearing stresses being generated in the direction perpendicular to the grain direction G upon lifting of the carton 105 so that the carton 105 is more resistant to tearing than, for example, a similar carton having similar handles with major axes oriented in a direction other than the grain direction G, for example, perpendicular to the grain direction G. Alternatively, to the embodiment illustrated in FIG. 1, the grain direction G could be rotated 90 degrees (corresponding to the lateral direction L2) and the handles 191*a*, 191*b* could also be rotated 90 degrees (corresponding to the lateral direction L2) without departing from the disclosure.

In one exemplary embodiment, the carton 105 can be opened and the containers C inside may be accessed by opening the dispenser 197. Opening the dispenser 197 includes activating the access tab 204 and tearing the dispenser panel 198 along tear line 199 to separate the dispenser panel 198 from the side panel 113. The carton 105 can be positioned in the open position as shown in FIG. 5 by positioning or moving the dispenser panel 198 and the flexible handle panel 202 toward the second side panel 117. In one embodiment, the dispenser panel 197 and is connected to the flexible handle panel 202, and the flexible handle panel 202 can be folded back and remain foldably connected to the second side panel 117 when the dispenser 197 is activated to allow access to the containers C in the interior 205 of the carton 105. The dispenser 197 could have other features, be otherwise arranged, or omitted without departing from the disclosure.

Figure 6:
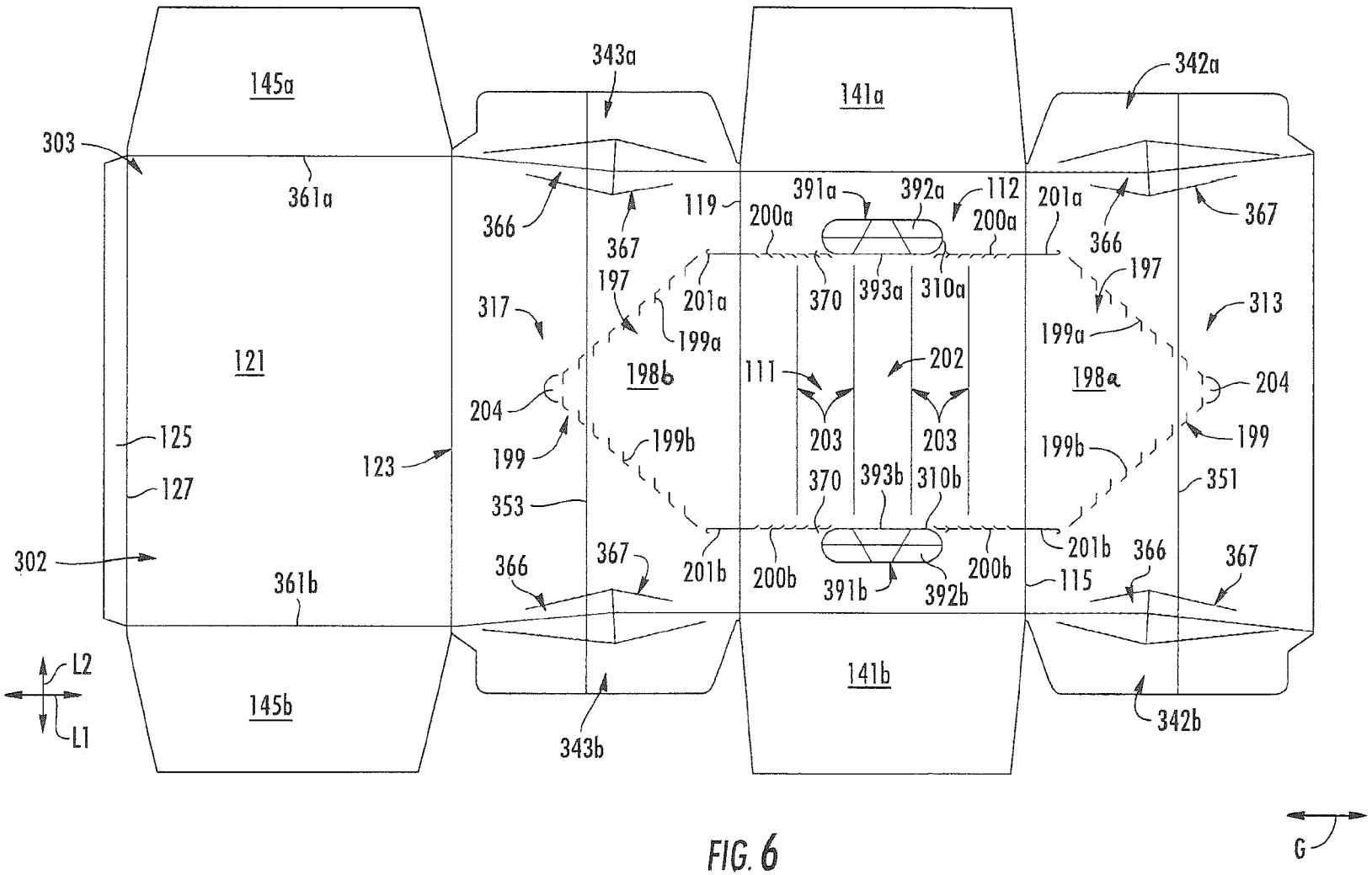
FIG. 6 is a plan view of an exterior surface of a blank for forming a carton according to a second embodiment of this disclosure.
Figure 13:
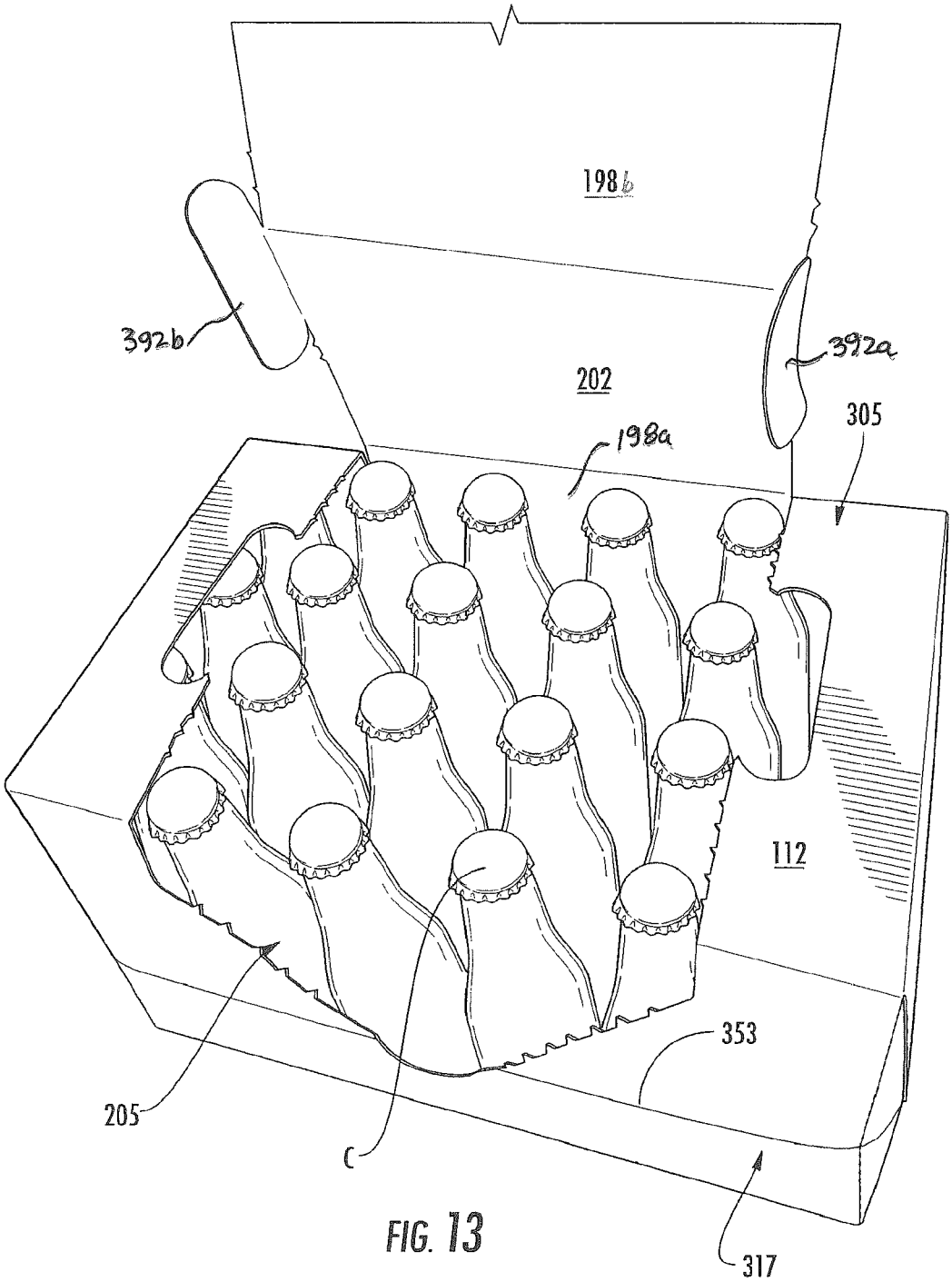
FIG. 13 is a perspective view of the carton of FIG. 6 with a dispenser panel partially separated.
Figure 14:
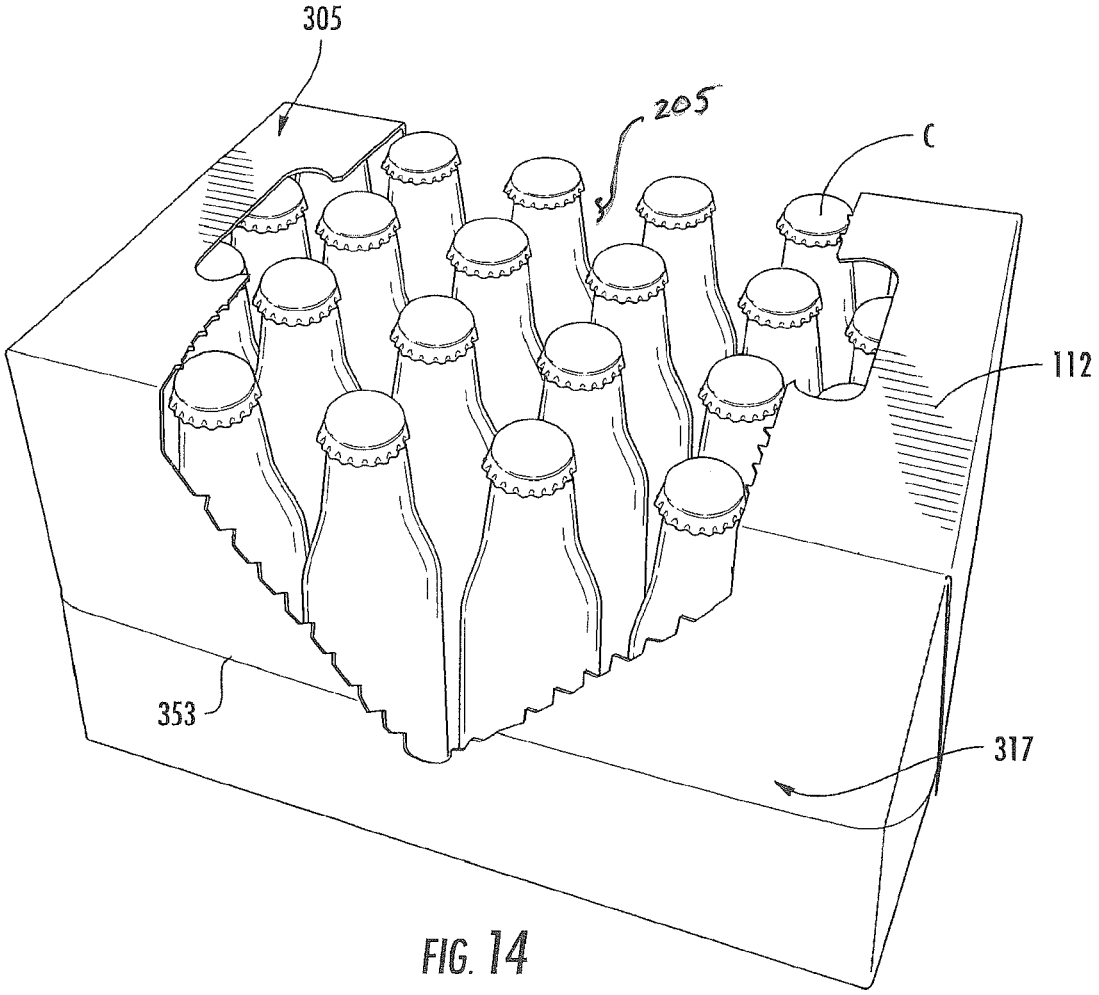
FIG. 14 is a perspective view of the carton of FIG. 6 with a dispenser panel completely separated.

FIG. 6 is a plan view of an exterior surface 302 of an alternative blank 303 for forming a carton 305 (FIG. 8) according to a second embodiment of the disclosure. The carton 305 can be used to house a plurality of articles such as containers C (FIGS. 13-14). The carton 305 has handle features, generally indicated at 111, for grasping and carrying the carton. In one embodiment, the blank 303 is sized to form a carton 305 that contains twenty-four containers C that can be glass beverage bottles in one layer (e.g., a 4×6×1 arrangement). The second embodiment is generally similar to the first embodiment, except for variations noted and variations that will be apparent to one of ordinary skill in the art. Accordingly, similar or identical features of the embodiments have been given like or similar reference numbers.

As shown in FIG. 6, the blank 303 includes a top panel 112 foldably connected to a first side panel 313 at a lateral fold line 115. A second side panel 317 is foldably connected to the top panel 112 at a lateral fold line 119. A bottom panel 121 is foldably connected to the second side panel 317 at a lateral fold line 123.

In one embodiment, the first side panel 313 is foldably connected to a first side end flap 342*a* and a second side end flap 342*b*. The second side panel 317 is foldably connected to a first side end flap 343*a* and a second side end flap 343*b*. In one embodiment, when the carton 305 is erected, the end flaps 141*a*, 342*a*, 343*a*, 145*a* close the first end 349*a* of the carton, and the end flaps 141*b*, 342*b*, 343*b*, 145*b* close the second end 349*b* of the carton.

As shown in FIG. 6, each of the side panels 313, 317 include a respective lateral fold line 351, 353 extending across each respective side panel and across the respective end flaps 342*a*, 342*b* and 343*a*, 343*b*. One or more of the fold lines 351, 353 could be omitted or could be otherwise shaped, arranged, configured, and/or positioned without departing from the disclosure.

The end flaps 141*a*, 342*a*, 343*a*, 145*a* extend along a first marginal area of the blank 303, and are foldably connected at a first longitudinal fold line 361*a* that extends along the length of the blank. The end flaps 141*b*, 342*b*, 343*b*, 145*b* extend along a second marginal area of the carton blank 303, and are foldably connected at a second longitudinal fold line 361*b* that also extends along the length of the blank. In the illustrated embodiment, the side panels 313, 317 include diamond corner panels 366 defined by fold lines 367 that allow the closed ends 349*a*, 349*b* to be configured with a lower portion that is farther from the center of the carton than a top portion of the closed ends. In one embodiment, the diamond corners 366 can generally correspond to the curvature of the necks of containers (i.e., bottles) held inside the carton.

In one embodiment, the handle features 111 include a first handle 391*a* in the top panel 112 having a first handle flap 392*a* foldably connected to the top panel 112 along a longitudinal fold line 193*a*. As shown in FIG. 6, the first handle 391*a* includes a cut 310*a* extending between respective ends of the fold line 393*a* to define the handle flap 392*a*. The handle features 111 include a handle opening 396*a* in the top panel 112 that is formed by folding the first handle flap 392*a*. In one embodiment, the first handle flap 392*a* may be omitted or alternatively the first handle flap 392*a* may be replaced with an opening or cutout without departing from the disclosure.

As shown in FIG. 6, the handle features 111 include a first tear line 200*a* extending generally from a respective end of the first handle 191*a* and terminating at a respective j-shaped cut 201*a* in a respective one of the first side panel 313 and the second side panel 317. The handle features 111 can be alternatively arranged without departing from the disclosure. In the illustrated embodiment, the dispenser 197 comprises a first dispenser panel 198*a* in the first side panel 313 and a second dispenser panel 198*b* in the second side panel 317. Each dispenser panel 198*a*, 198*b* is removably attached to the carton 305 at a tear line, generally indicated at 199. The tear line 199 comprises an access tab 204 and two oblique portions 199*a*, 199*b* extending from the access tab and ending near or adjacent the j-shaped cuts 201*a*, 201*b* in a respective side panel 313, 317. The tear line 199 could be otherwise shaped, arranged, and/or configured without departing from the disclosure. For instance, the tear line 199 could be shaped to include lateral portions and multiple access tabs 204 without departing from the disclosure.

In one embodiment, the handle features 111 in the top panel 112 include a second handle 391*b* having a second handle flap 392*b* foldably connected to the top panel 112 along a longitudinal fold line 393*b*. As shown in FIG. 6, the second handle 391*b* includes a cut 310*b* extending between respective ends of the fold line 393*b* to define the handle flap 392*b*. The handle features 111 include a second handle opening 396*b* in the top panel 112 that is formed by folding the second handle flap 392*b*. In one embodiment, the second handle flap 392*b* may be omitted or alternatively the second handle flap 392*b* may be replaced with an opening or cutout without departing from the disclosure. Further, the handle features 111 include a second tear line 200*b* extending generally from a respective end of the handle 391*b* and terminating at a respective j-shaped cut 201*b* in a respective one of the first side panel 313 and the second side panel 317. The second handle 391*b* can be alternatively shaped, arranged, or omitted without departing from the disclosure.

As illustrated in FIG. 1, the first and second handles 391*a* and 391*b* are placed parallel with the grain direction G of the material (e.g., paperboard, cardboard, or other suitable material), increasing the strength of the carton 305 when lifted at the handles 391*a*, 391*b*. The increase in tear strength of the handles when lifted allows for a lower caliper board to be used than compared to standard cartons thus reducing cost of the carton and reducing environmental impact.

In one embodiment, the first tear line 200*a*, the second tear line 200*b*, the fold lines 393*a*, 393*b* and the j-shaped cuts 201*a*, 201*b* define a flexible handle panel 202 similar to the flexible handle panel of the first embodiment. A plurality of lateral lines of weakening 203 may extend at least partially across the flexible handle panel 202. In the illustrated embodiment, the dispenser 197 includes the first dispenser panel 198*a*, the second dispenser panel 198*b*, and the flexible handle panel 202. In the embodiment of FIGS. 6-14, the dispenser 197 is configured for complete detachment from the carton 305, in that the first dispenser panel 198*a*, 198*b*, and the flexible handle panel 202 can be removed to access the containers C in the interior 205 of the carton 305 when the dispenser is activated. The dispenser 197 of the carton 305 could be otherwise shaped, arranged, and/or configured without departing from the disclosure.

Figure 7:
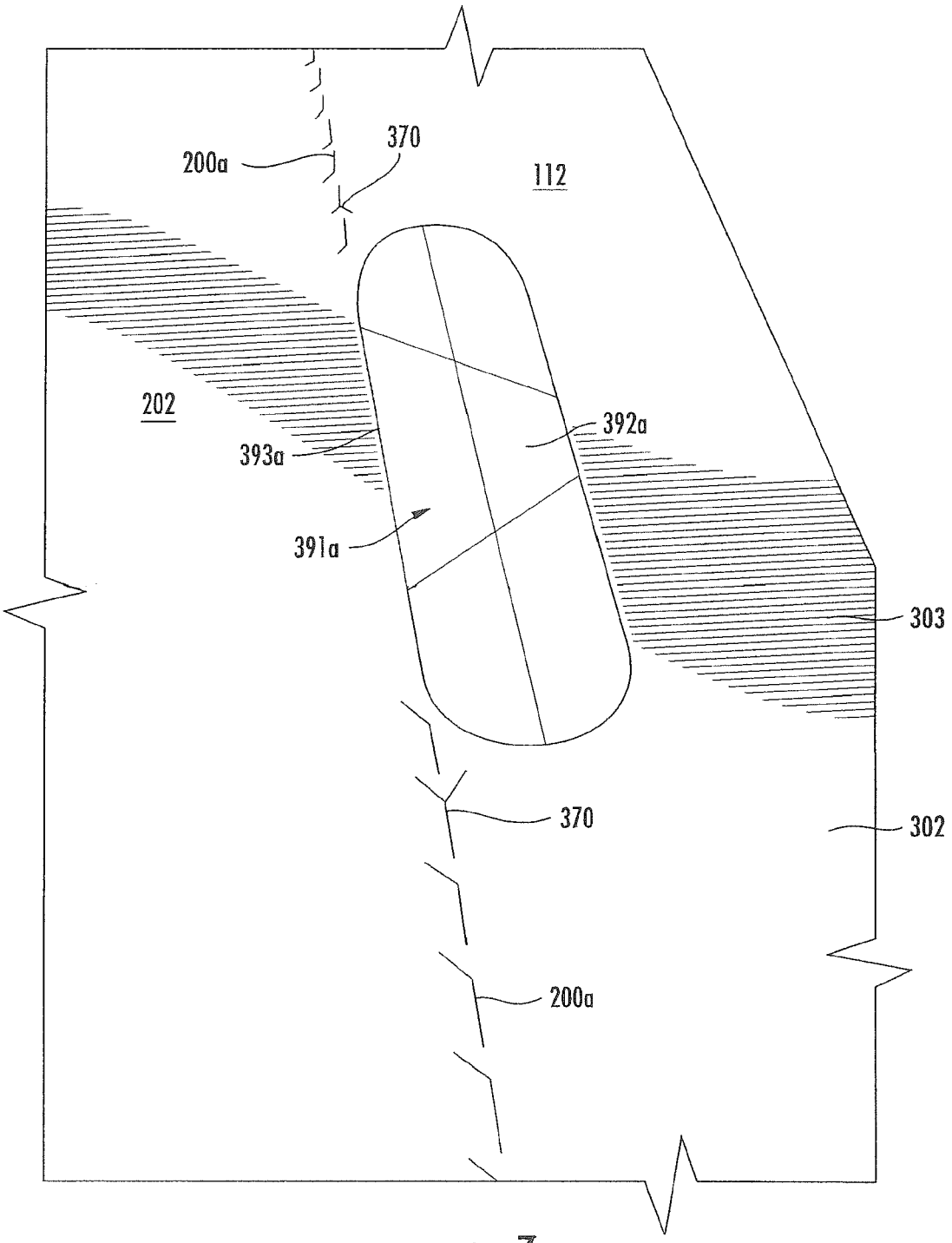
FIG. 7 is a close-up view of a handle of the carton of FIG. 6.

In one embodiment as illustrated in FIG. 7, the tear lines 200*a* and 200*b* can include a 'Y' shaped perforation or cut 370 adjacent the handle panels 393*a*, 393*b*. The 'Y' shaped perforations help control and direct the tearing when the flexible handle panel 202 is separated from the carton 305.

In one exemplary method the carton 305 can be formed from the blank 303 by folding the blank 303 along the lateral fold lines 119, 127 so that the side panel 313 overlaps at least a portion of the exterior surface of the attachment panel 127. The attachment panel 125 can be glued to the first side panel 113.

The blank 303 then can be folded along fold lines 115, 119, 123, 127 to form an open-ended sleeve with an interior 205. The containers or articles can be loaded into the interior 205 of the open-ended sleeve before or after closing either of the ends 349*a*, 349*b*. The blank 103 may be otherwise formed into the open-ended sleeve using alternative folding and gluing steps without departing from the scope of this disclosure.

Next, each respective end 349*a*, 349*b* can be closed by at least partially overlapping and adhering the end flaps 141*a*, 342*a*, 343*a*, 145*a* at the end 349*a* of the carton 305 and at least partially overlapping and adhering the end flaps 141*b*, 342*b*, 343*b*, 145*b* at the other end 349*b* of the carton. In one embodiment, the diamond corners 366 of respective side end flaps 342*a*, 343*a*, 342*b*, 343*b* are angled or positioned to be oblique relative to the side panels 313, 317. The top end flap 141*a* and the bottom end flap 145*a* are folded inwardly along respective fold lines 361*a* to at least partially overlap the end flaps 342*a*, 343*a*. Further, the end flaps 342*a*, 343*a* are adhered in face-to-face contact with the end flaps 141*a*, 145*a*.

Figure 8:
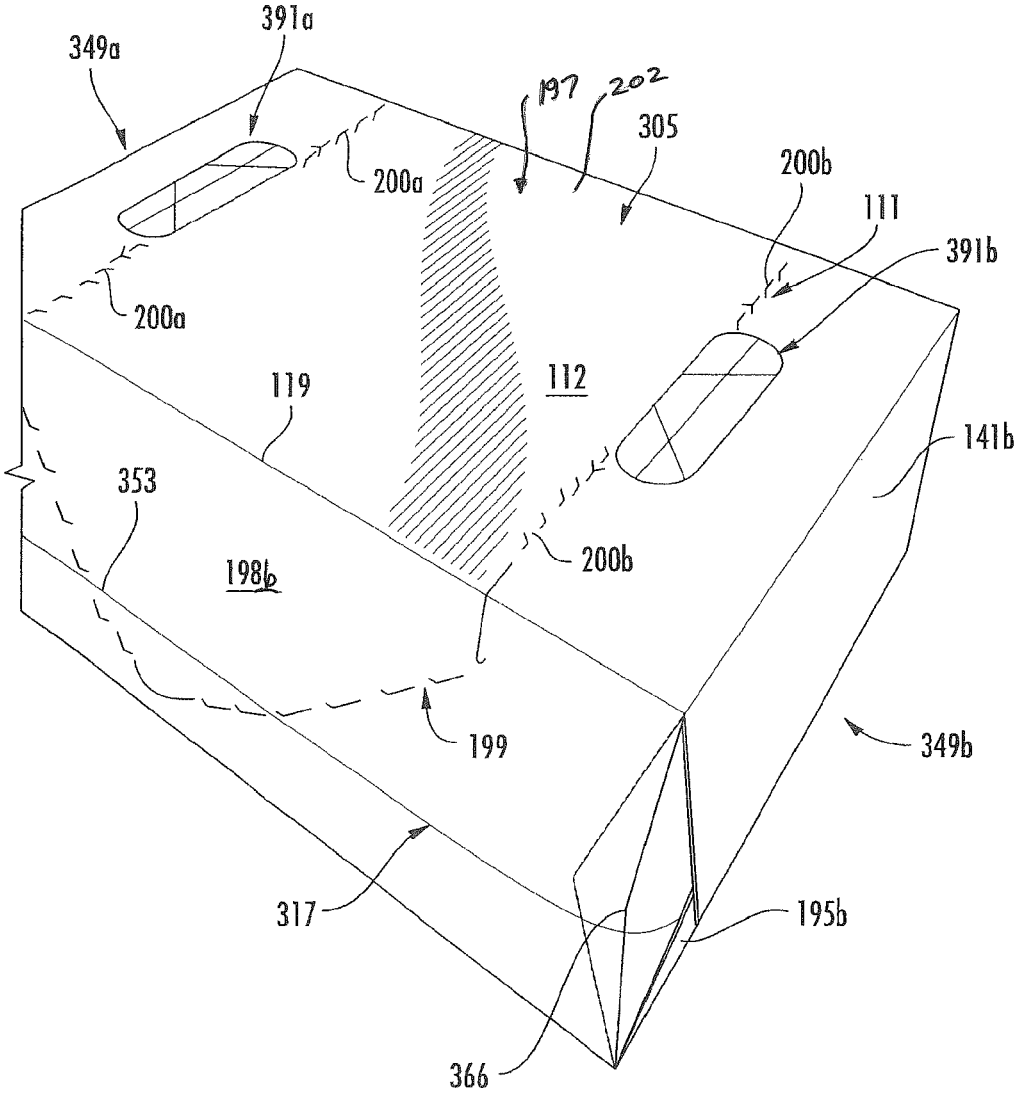
FIG. 8 is a perspective view of the carton of FIG. 6.

In one embodiment, the second end 349*b* of the carton 105 can be closed in a similar manner as the first end 349*a* by folding, respectively overlapping, and selectively adhering the end flaps 141*b*, 342*b*, 343*b*, 145*b*. The assembled carton 305 is shown in FIG. 8. The ends 349*a*, 349*b* of the carton 305 could be closed by other closing steps and features without departing from the disclosure. One or both of the ends 349*a*, 349*b* could be otherwise shaped, arranged, configured, or omitted, without departing from the disclosure.

Figure 9:
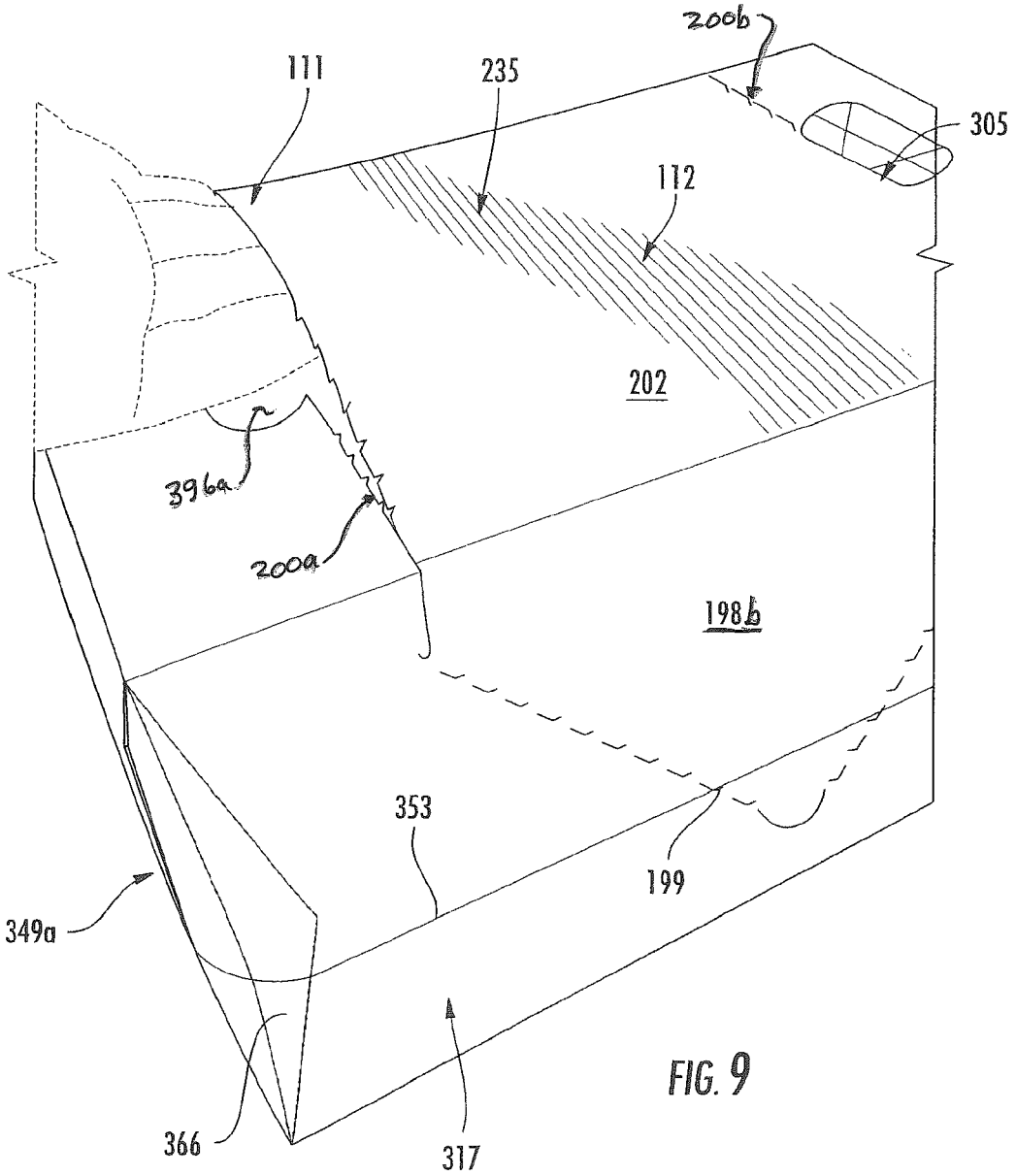
FIG. 9 is a perspective view of the carton of FIG. 6 with a flexible handle panel activated.
Figure 11:
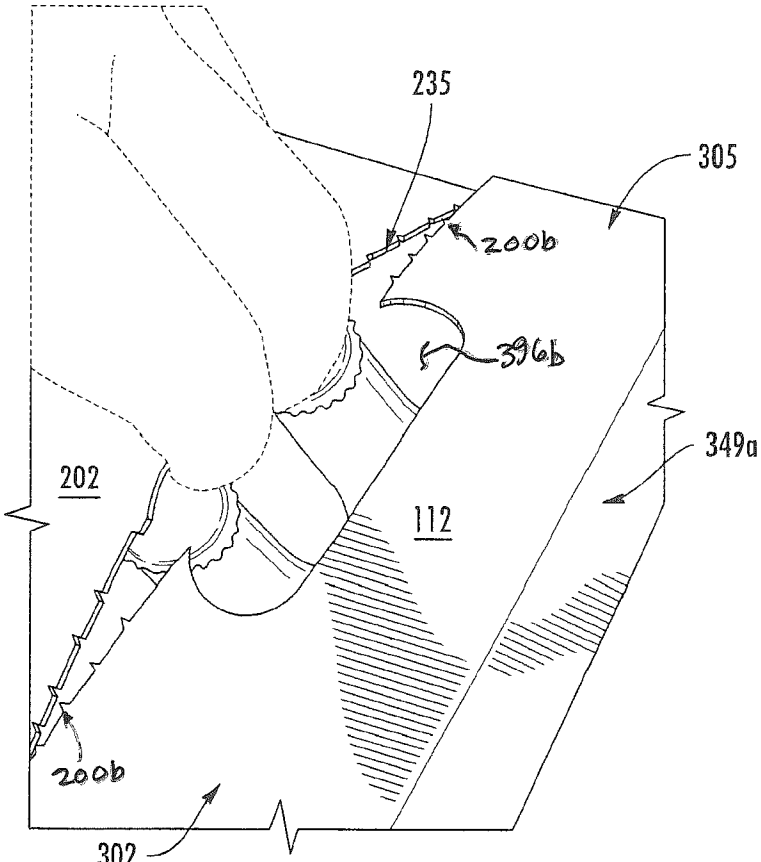
FIG. 11 is a close-up view of a handle of the carton of FIG. 6 with a flexible handle panel activated.
Figure 10:
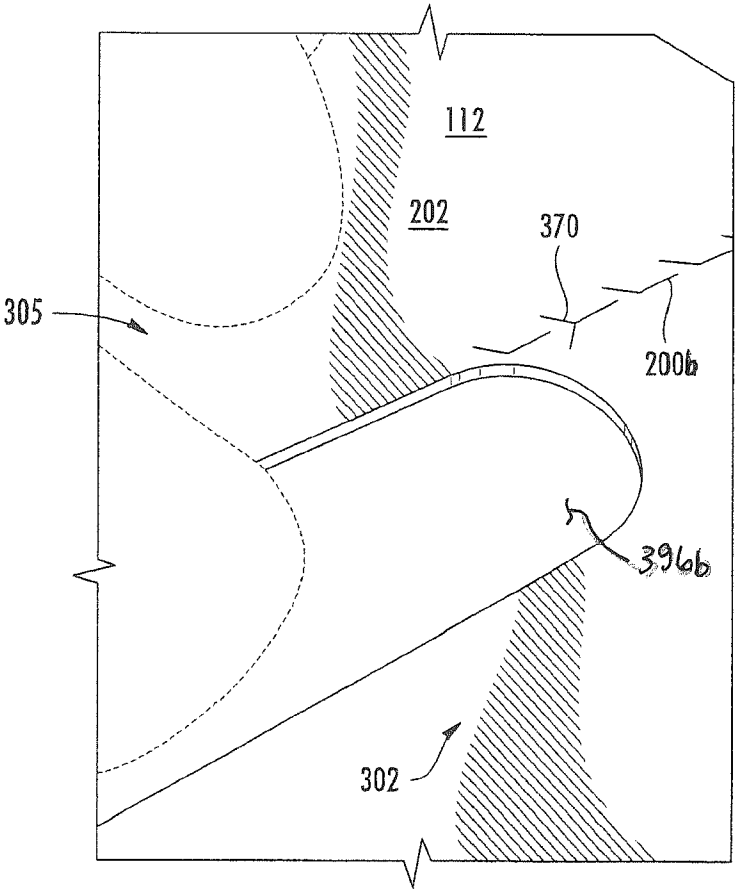
FIG. 10 is a close-up view of a handle of the carton of FIG. 6 with handle flaps separated.

One exemplary method of forming the flexible handle 235 includes folding the handle flaps 392*a*, 392*b* inward along respective fold lines 393*a*, 393*b* to form the handle openings 396*a*, 396*b*. Then the carton 305 can be lifted by inserting a user's hands through a respective handle opening 396*a*, 396*b* and grasping the handle panel 202 to initiate tearing along tear lines 200*a*, 200*b* and cuts 201*a*, 201*b*. As shown in FIG. 9, the carton 305 can be carried by the handle 235 so that the flexible handle panel 202 flexes upwardly when the carton is grasped at the handle openings 396*a*, 396*b* of the handles 391*a*, 391*b* adjacent the handle panel. The flexible handle 235 allows the consumer or user to lift the carton 305 while using two hands and the suggested lifting technique of bending at the knees and maintaining a natural curve of the back.

Figure 12:
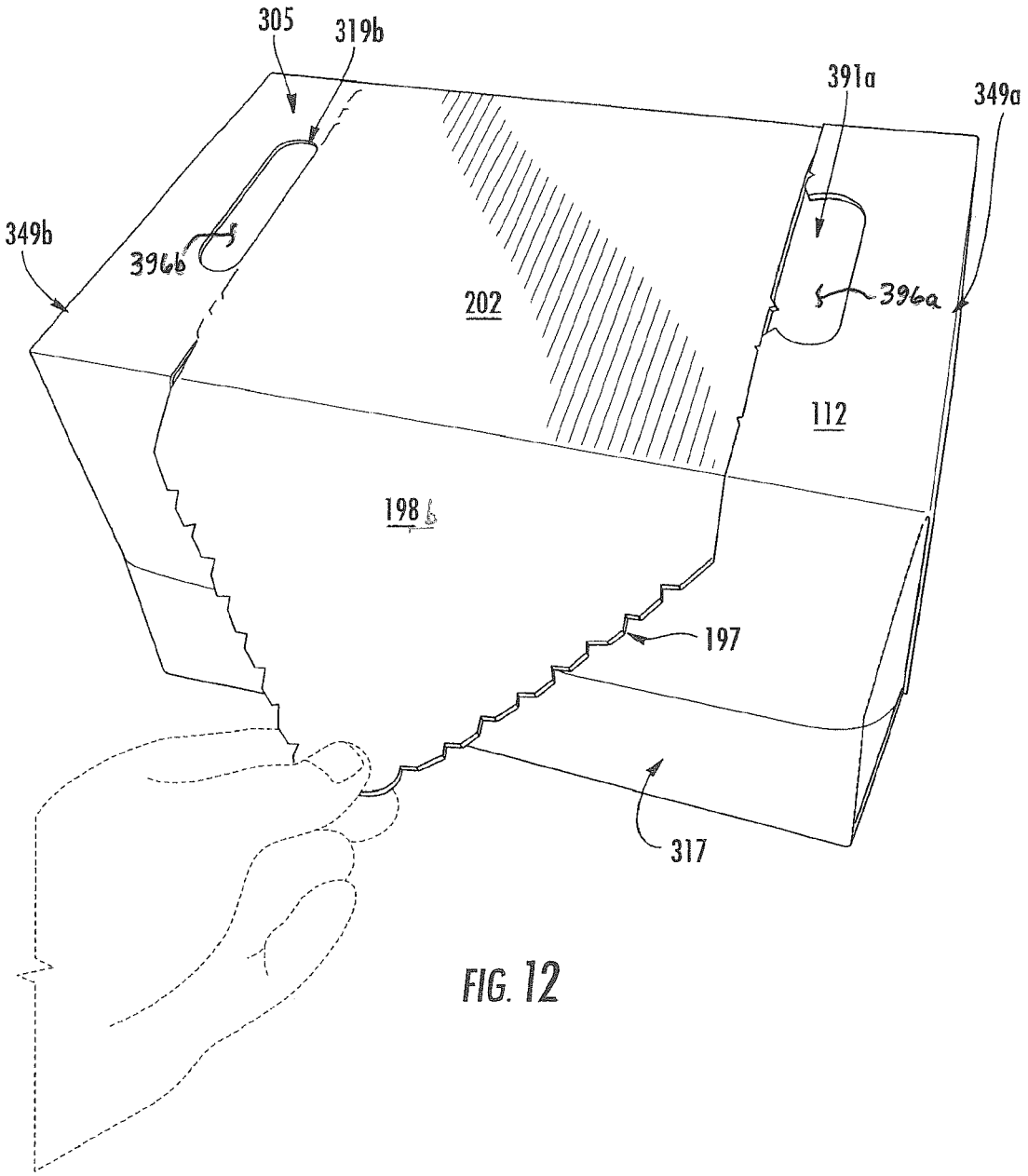
FIG. 12 is a perspective view of the carton of FIG. 6 with a dispenser panel partially separated.

In one exemplary embodiment, the carton 305 can be opened by activating the dispenser 197 in similar way as described above for the first exemplary embodiment. The dispenser 197 is activating accessing one or both of the access tabs 204 and tearing one of the dispenser panels 198*a*, 198*b* along a respective tear line 199 to separate the dispenser panel 198*a*, 198*b* from a respective side panel 313, 317. As shown in FIGS. 12-14, the dispenser panel 198*b* is torn first, but the other dispenser panel 198*a* could be torn first or both the dispenser panels could be torn simultaneously without departing from the disclosure. In the second embodiment, the flexible handle panel 202 is foldably connected to both the dispenser panels 198*a*, 198*b* so that the flexible handle panel is removed with the dispenser panels when the dispenser 197 is activated to access the interior 205 of the carton 305. The dispenser 197 of the second embodiment of the carton 305 could be otherwise shaped, arranged, configured, and/or activated in an alternative manner without departing from the disclosure.

In general, the blanks described herein may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for carrying a plurality of articles, comprising:

a plurality of panels for at least partially forming an interior of the carton, the plurality of panels comprising a top panel, a bottom panel, a first side panel, and a second side panel;

a handle in at least the top panel, the handle comprises a first handle flap foldably connected to the top panel for forming a first handle opening in the top panel, a second handle flap foldably connected to the top panel for forming a second handle opening in the top panel, and a flexible handle panel extending between the first handle flap and the second handle flap and defined by a tear line extending from at least one of the first handle flap and the second handle flap, the flexible handle panel comprises a portion of the first side panel, a portion of the top panel, and a portion of the second side panel; and a dispenser for accessing the interior of the carton, the dispenser comprises a dispenser panel comprising at least a portion of the first side panel and at least partially defined by a dispenser tear line, wherein the dispenser comprises the dispenser panel and the flexible handle panel, the flexible handle panel is configured for separation from the carton with the dispenser panel.

2. The carton of claim 1, wherein each of the first handle opening and the second handle opening defines a respective major axis that is substantially parallel to the grain direction.

3. The carton of claim 2, wherein each of the first handle opening and the second handle opening defines a respective minor axis that is substantially perpendicular to the respective major axis.

4. The carton of claim 1, wherein the flexible handle panel comprises a plurality of lateral fold lines extending at least partially across the flexible handle panel.

5. The carton of claim 1, wherein the flexible handle panel is configured to remain foldably connected to the carton when the dispenser is activated to access the interior of the carton.

6. The carton of claim 1, wherein the dispenser panel is a first dispenser panel in the first side panel and the dispenser comprises a second dispenser panel in the second side panel.

7. The carton of claim 6, wherein the flexible handle panel is configured to be removed with the first dispenser panel and the second dispenser panel when the dispenser is activated to access the interior of the carton.

8. The carton of claim 1, wherein the top panel is a single top panel of the plurality of panels that defines a top of the carton.

9. The carton of claim 1, wherein the first handle and second handle are positioned for lifting the carton by activation of both the first handle and second handle by the respective first hand and second hand of a user.

10. A blank for forming a carton for carrying a plurality of articles, the blank comprising:

a plurality of panels for at least partially forming an interior of the carton formed from the blank, the plurality of panels comprising a top panel, a bottom panel, a first side panel, and a second side panel;

a handle in at least the top panel, the handle comprises a first handle flap foldably connected to the top panel for forming a first handle opening in the carton formed from the blank, a second handle flap foldably connected to the top panel for forming a second handle opening in the carton formed from the blank, and a flexible handle panel extending between the first handle flap and the second handle flap and defined by a tear line extending from at least one of the first handle flap and the second handle flap, the flexible handle panel comprises a portion of the first side panel, a portion of the top panel, and a portion of the second side panel; and a dispenser for accessing the interior of the carton formed from the blank, the dispenser comprises a dispenser panel comprising at least a portion of the first side panel and at least partially defined by a dispenser tear line, wherein the dispenser comprises the dispenser panel and the flexible handle panel, the flexible handle panel is configured for separation from the carton with the dispenser panel.

11. The blank of claim 10, wherein each of the first handle opening and the second handle opening defines a respective major axis that is substantially parallel to the grain direction.

12. The blank of claim 11, wherein each of the first handle opening and the second handle opening defines a respective minor axis that is substantially perpendicular to the respective major axis.

13. The blank of claim 10, wherein the flexible handle panel comprises a plurality of lateral fold lines extending at least partially across the flexible handle panel.

14. The blank of claim 10, wherein the flexible handle panel is configured to remain foldably connected to the carton when the dispenser is activated to access the interior of the carton formed from the blank.

15. The blank of claim 10, wherein the dispenser panel is a first dispenser panel in the first side panel and the dispenser comprises a second dispenser panel in the second side panel.

16. The blank of claim 15, wherein the flexible handle panel is configured to be removed with the first dispenser panel and the second dispenser panel when the dispenser is activated to access the interior of the carton.

17. The blank of claim 10, wherein the top panel is a single top panel of the plurality of panels that is for defining a top of the carton formed from the blank.

18. A method of forming a carton for carrying a plurality of articles, the method comprising:

obtaining a plurality of panels comprising a top panel, a bottom panel, a first side panel, and a second side panel, a handle in at least the top panel, and a dispenser, the handle comprises a first handle flap foldably connected to the top panel, a second handle flap foldably connected to the top panel, and a flexible handle panel extending between the first handle flap and the second handle flap and defined by a respective tear line extending from each of the first handle flap and the second handle flap, the flexible handle panel comprises a portion of the first side panel, a portion of the top panel, and a portion of the second side panel, the dispenser comprises the flexible handle panel and a dispenser panel comprising at least a portion of the first side panel and at least partially defined by a dispenser tear line;

folding the plurality of panels to at least partially form an interior of the carton;

folding the first handle flap to form a first handle opening in the top panel and folding the second handle flap to form a second handle opening in the top panel, and grasping the flexible handle panel at the first handle opening and the second handle opening and tearing along the respective tear line to at least partially separate the flexible handle panel from the top panel; and activating the dispenser by tearing along the dispenser tear line to at least partially separate the dispenser panel from the carton to provide access to the interior of the carton, the activating the dispenser comprises the flexible handle panel remaining foldably connected to the dispenser panel so that the flexible handle panel and the dispenser panel are both at least partially separated from the carton.

19. The method of claim 18, wherein each of the first handle opening and the second handle opening defines a respective major axis that is substantially parallel to the grain direction.

20. The method of claim 19, wherein each of the first handle opening and the second handle opening defines a respective minor axis that is substantially perpendicular to the respective major axis.

21. The method of claim 18, wherein the flexible handle panel comprises a plurality of lateral fold lines extending at least partially across the flexible handle panel, and the method comprises lifting the carton at the flexible handle panel and bending the flexible handle panel relative to the carton.

22. The method of claim 18, wherein the flexible handle panel remains foldably connected to the carton when the dispenser is activated to access the interior of the carton formed from the blank.

23. The method of claim 18, wherein the dispenser panel is a first dispenser panel in the first side panel and the dispenser comprises a second dispenser panel in the second side panel.

24. The method of claim 23, wherein the activating the dispenser comprises removing the flexible handle panel with the first dispenser panel and the second dispenser panel to provide access to the interior of the carton.

25. The method of claim 18, wherein the top panel is a single top panel of the plurality of panels that defines a top of the carton.

26. The method of claim 18, further comprising lifting the carton by activating the first handle and the second handle and simultaneously lifting the carton at the first handle with the first hand of a user and at the second handle with the second hand of the user.

* * * * *